US005947075A

United States Patent [19]

Ryu et al.

[11] Patent Number: 5,947,075

[45] Date of Patent: Sep. 7, 1999

[54] LUBRICATING SYSTEM IN A 4-CYCLE ENGINE

[75] Inventors: Yasutake Ryu; Souhei Honda; Takao Nishida; Takanori Tsugekawa, all of Wako, Japan

[73] Assignee: Honda Giken Kogyo Kabushiki Kaisha, Tokyo, Japan

[21] Appl. No.: 08/764,813

[22] Filed: Dec. 12, 1996

[30] Foreign Application Priority Data

| | | | |
|---|---|---|---|
| Dec. 15, 1995 | [JP] | Japan | 7-327665 |
| Dec. 15, 1995 | [JP] | Japan | 7-327667 |
| Dec. 20, 1995 | [JP] | Japan | 7-331602 |
| Dec. 26, 1995 | [JP] | Japan | 7-339373 |

[51] Int. Cl.[6] ..... F01M 1/00

[52] U.S. Cl. ..... 123/196 W; 123/185.3; 184/11.1

[58] Field of Search ..... 123/196 W, 185.3; 184/11.1, 6.6

[56] References Cited

U.S. PATENT DOCUMENTS

| | | | |
|---|---|---|---|
| 4,766,859 | 8/1988 | Miyaki et al. | 123/196 W |
| 4,955,335 | 9/1990 | Jingu et al. | 123/196 M |
| 5,031,591 | 7/1991 | Shinoda et al. | 123/196 W |
| 5,243,937 | 9/1993 | Imagawa | 123/195 R |
| 5,588,408 | 12/1996 | Kurihara | 123/196 W |
| 5,765,438 | 6/1998 | Chang | 123/185.3 |

FOREIGN PATENT DOCUMENTS 211326 8/1990 Japan .

*Primary Examiner*—John Kwon

*Attorney, Agent, or Firm*—Armstrong, Westerman, Hattori, McLeland & Naughton

[57] ABSTRACT

An oil reservoir chamber, a crank chamber and a valve-operating chamber are provided in an engine body. The oil reservoir chamber and the crank chamber are in communication with each other through a through-hole, and the crank chamber and the valve-operating chamber are in communication with the each other through a one-way valve which is opened upon rising of the pressure in the crank chamber. The valve-operating chamber and the oil reservoir chamber are in communication with each other through an orifice. By utilizing a pressure pulsation in the crank chamber, an oil mist produced in the oil reservoir chamber is circulated from the oil reservoir chamber to the crank chamber, the valve-operating chamber and the oil reservoir chamber. Thus, in any operational attitude of an engine, the lubricating oil can be circulated without use of special oil pump.

7 Claims, 25 Drawing Sheets

LUBRICATING SYSTEM IN A 4-CYCLE ENGINE

BACKGROUND OF THE INVENTION

1. Field of the Invention

The present invention relates to a system for lubricating a hand-held type 4-cycle engine used as a power source mainly for a trimmer or a chain saw.

2. Description of the Related Art

The conventional hand-held type engine widely used in these applications is a 2-cycle engine capable of exhibiting a lubricating function in any operational attitude of the engine such as inclined and sideways-fallen attitudes.

However, as such a hand-held type engine, it is desirable to use a 4-cycle engine from the viewpoint of an exhaust emission control. In the 4-cycle engine, however, it is necessary to store an oil exclusively used for lubrication. Therefore, if the 4-cycle engine is used as the hand-held type engine, it is necessary to reliably lubricate various portion of the engine in any operational attitude of the engine.

SUMMARY OF THE INVENTION

Accordingly, it is one object of the present invention to provide a 4-cycle engine lubricating system capable of satisfying the above requirements for use in hand-held tools.

To achieve the above object, according to a first aspect and feature of the present invention, there is provided a system for lubricating a 4-cycle engine, comprising: an oil reservoir chamber which stores a lubricating oil therein and has an oil mist producing means contained therein for producing an oil mist from the lubricating oil; a crank chamber having a crank portion of a crankshaft contained therein; and a valve-operating chamber having a valve-operating device contained therein, the oil reservoir chamber, the crank chamber and the valve operating chamber being provided in an engine body, the oil reservoir chamber and the crank chamber being in communication with each other through a through-hole above an oil level in the oil reservoir chamber, the crank chamber and the valve operating chamber being in communication with each other through a control valve which is opened upon rising of the pressure in the crank chamber and closed upon reduction of the pressure in the crank chamber, the valve-operating chamber being substantially in communication at its upper portion with the atmosphere and at its bottom portion with the oil reservoir chamber through an orifice, and the following expression is established during operation of the engine;

$$Pc \leqq Po < Pv$$

wherein Pc is a pressure in the crank chamber; Po is a pressure in the oil reservoir chamber; and Pv is a pressure in the valve-operating chamber.

With the first feature of the present invention, in any inclined state of the engine, the oil mist can be constantly circulated to the oil reservoir chamber, the crank chamber, the valve-operating chamber and the oil reservoir chamber and the oil liquified in the valve-operating chamber can be circulated to the oil reservoir chamber by utilizing the magnitude of the differences between the pressures in the chambers, thereby insuring a good lubricating state. Moreover, an expensive oil pump is not required and hence, this lubricating system is convenient even in a respect of cost.

According to a second aspect and feature of the present invention, in addition to the above first feature, the system further includes an uppermost chamber which occupies a position above the valve-operating chamber and communicates with the valve-operating chamber through an orifice and also communicates with the oil reservoir chamber or the crank chamber through an oil passage, and the following expression is established during operation of the engine:

$$Pc \leqq Po \sim \leqq Pt < Pv$$

wherein Pt is a pressure in the uppermost chamber.

With the above second feature of the present invention, not only the circulation of the oil mist but also the circulation of the oil liquified and accumulated in the uppermost chamber can be reliably performed, and a good lubricating state can be insured.

According to a third aspect and feature of the present invention, in addition to the above first feature, the oil mist producing means comprises an oil slinger which is rotated by the crankshaft to agitate and scatter the lubricating oil in the oil reservoir chamber at all times irrespective of the inclined state of the engine.

With the third feature of the present invention, the oil mist can be reliably produced in the oil reservoir chamber by the rotation of the oil slinger in any operational attitude of the engine and moreover, the structure of the oil slinger is relatively simple.

According to a fourth aspect and feature of the present invention, in addition to the first or second feature, the control valve comprises a one-way valve of a pressure responsive type.

With the fourth feature, the one-way valve can be opened and closed in operative association with the pressure pulsation in the crank chamber to transfer the oil mist from the crank chamber into the valve-operating chamber and to maintain the crank chamber in an averagely negative pressure state. Particularly, the sealing function is good during closing of the one-way valve and hence, the lubricating system is effective for an engine rotating at relatively lower speeds.

According to a fifth aspect and feature of the present invention, in addition to the first or second feature, the control valve comprises a rotary valve which is opened upon the lowering movement of a piston operatively associated with the rotation of the crankshaft and closed upon the elevating movement of the piston.

With the fifth feature, the rotary valve can be opened and closed in mechanically operative association with the rotation of the crankshaft to transfer the oil mist from the crank chamber into the valve-operating chamber and to maintain the crank chamber in an averagely negative pressure state. Particularly, a deviation in timing of opening and closing of the rotary valve cannot be produced and hence, the lubricating system is effective for a relatively lower-speed rotated type engine.

According to a sixth aspect and feature of the present invention, in addition to the fifth feature, the opening duration of the rotary valve is approximately 180° in terms of a crank angle, and the start point of opening of the rotary valve is set in a range of from a middle point between top and bottom dead centers of the piston to a lowering-piston position of 45° of the piston in terms of the crank angle.

With the sixth feature of the present invention, the discharge of a positive pressure from the crank chamber into the valve-operating chamber can be effectively performed by utilizing an inertial effect of a gas during rotation of the engine at a high speed. Therefore, the transferring of the oil mist and insuring of the negative pressure state of the crank chamber can be more reliable.

The above and other objects, features and advantages of the invention will become apparent from the following description of preferred embodiments taken in conjunction with be accompanying drawings.

BRIEF DESCRIPTION OF THE DRAWINGS

FIGS. 1 to 10 show a first embodiment of the present invention, wherein FIG. 1 is an illustration for explaining the service state of a power trimmer equipped with an engine including one lubricating system according to the invention;

FIG. 2 is a vertical sectional front view of the engine;

FIG. 3 is a sectional view taken along the line 3—3 in FIG. 2;

FIG. 4 is a sectional view taken along the line 4—4 in FIG. 2;

FIG. 5 is a sectional view taken along the line 5—5 in FIG. 2;

FIG. 6 is a sectional view taken along the line 6—6 in FIG. 2;

FIG. 7 is a sectional view taken along the line 7—7 in FIG. 2;

FIG. 8 is a sectional view taken along the line 8—8 in FIG. 2;

FIG. 9 is a sectional view taken along the line 9—9 in FIG. 2.

FIGS. 11 to 14 show a modification of the engine, wherein FIG. 11 is a vertical sectional view of an engine;

FIG. 12 is a sectional view taken along the line 12—12 in FIG. 11;

FIG. 13 is a sectional view showing an opened state of the rotary valve; and FIG. 14 is a diagram illustrating the opening and closing timing of the rotary valve;

FIGS. 15 to 25 show a second embodiment of the present invention, wherein FIG. 15 is a side view of an engine including a lubricating system;

FIG. 16 is a vertical sectional front view of the engine;

FIG. 17 is an enlarged view of an essential portion shown in FIG. 16;

FIG. 18 is a sectional view similar to FIG. 17, but illustrating a different operational state of the rotary valve;

FIG. 19 is a sectional view taken-along the line 13–19 in FIG. 16;

FIG. 20 is a sectional view taken along the line 20—20 in FIG. 16;

FIG. 21 is a sectional view taken along the line 21—21 in FIG. 16;

FIG. 22 is a sectional view taken along the line 22—22 in FIG. 16;

FIG. 23 is a sectional view taken along the line 23—23 in FIG. 17;

FIG. 24 is a sectional view showing the state of a lubricating oil in a crank chamber when the engine is fallen sideways; and FIG. 25 is a sectional view showing the state of the lubricating oil in the crank chamber when the engine is inverted or turned upside down.

DETAILED DESCRIPTION OF THE PREFERRED EMBODIMENTS

The present invention will now be described by way of preferred embodiments with reference to the accompanying drawings.

Figure 1:
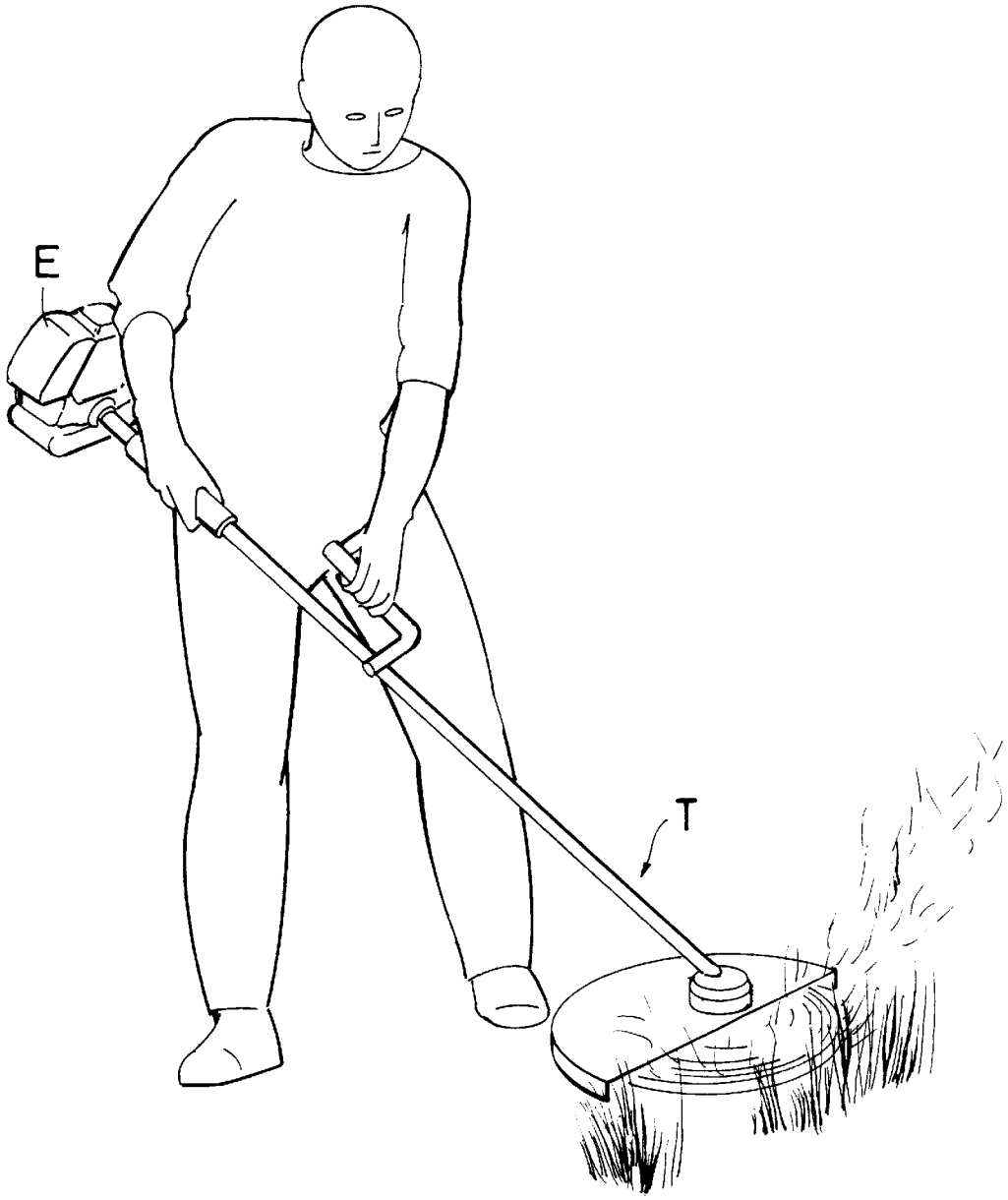

A first embodiment of the present invention shown in FIGS. 1 to 10 will be first described. Referring to FIG. 1, a hand-held type 4-cycle engine E is mounted, for example, as a power source for a power trimmer T, to a drive section of the power trimmer T. The power trimmer T is used with its cutter turned in each of various directions depending upon its working state and hence, is largely inclined or turned upside down, wherein its working state is not constant.

Figure 2:
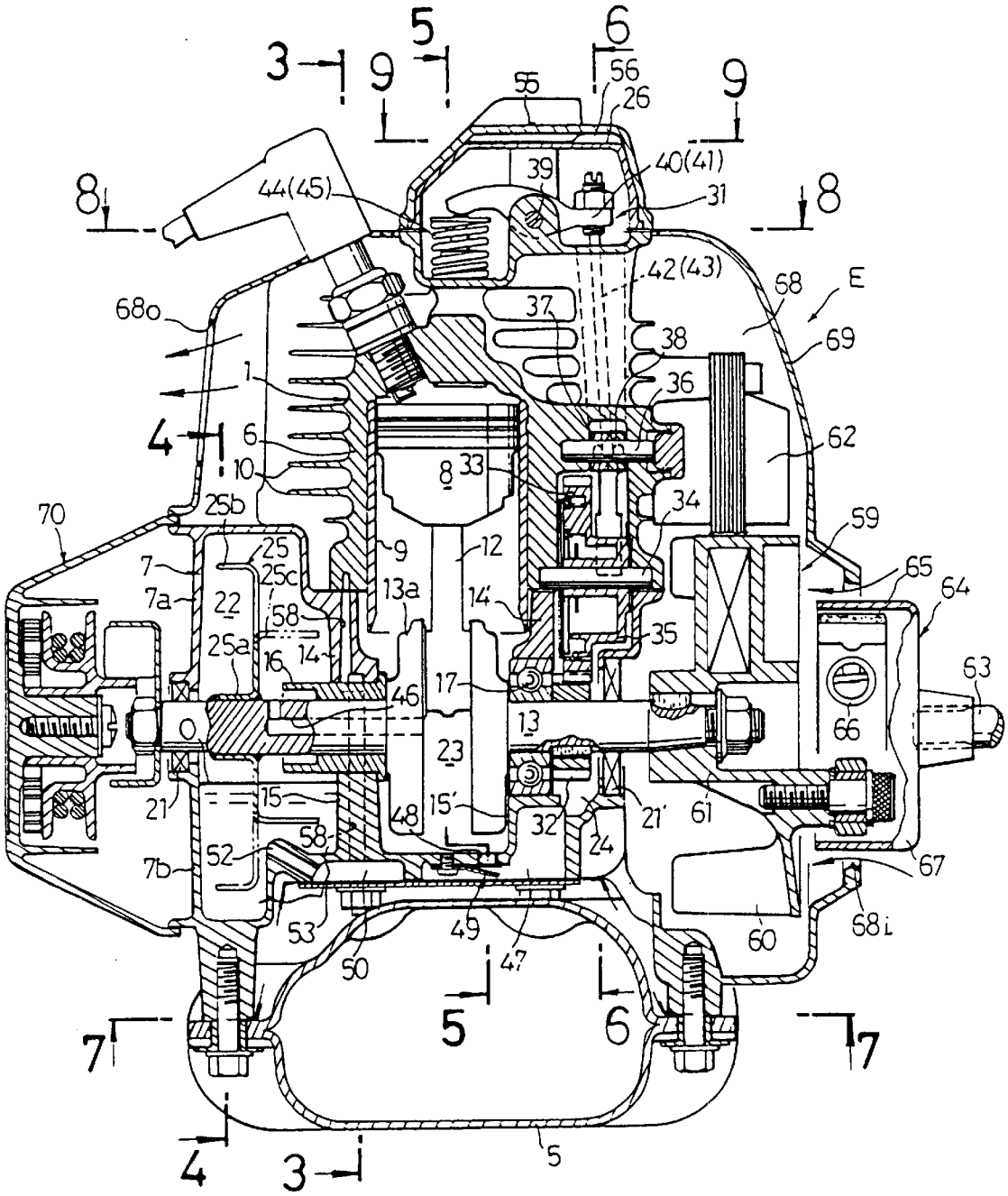
Figure 3:
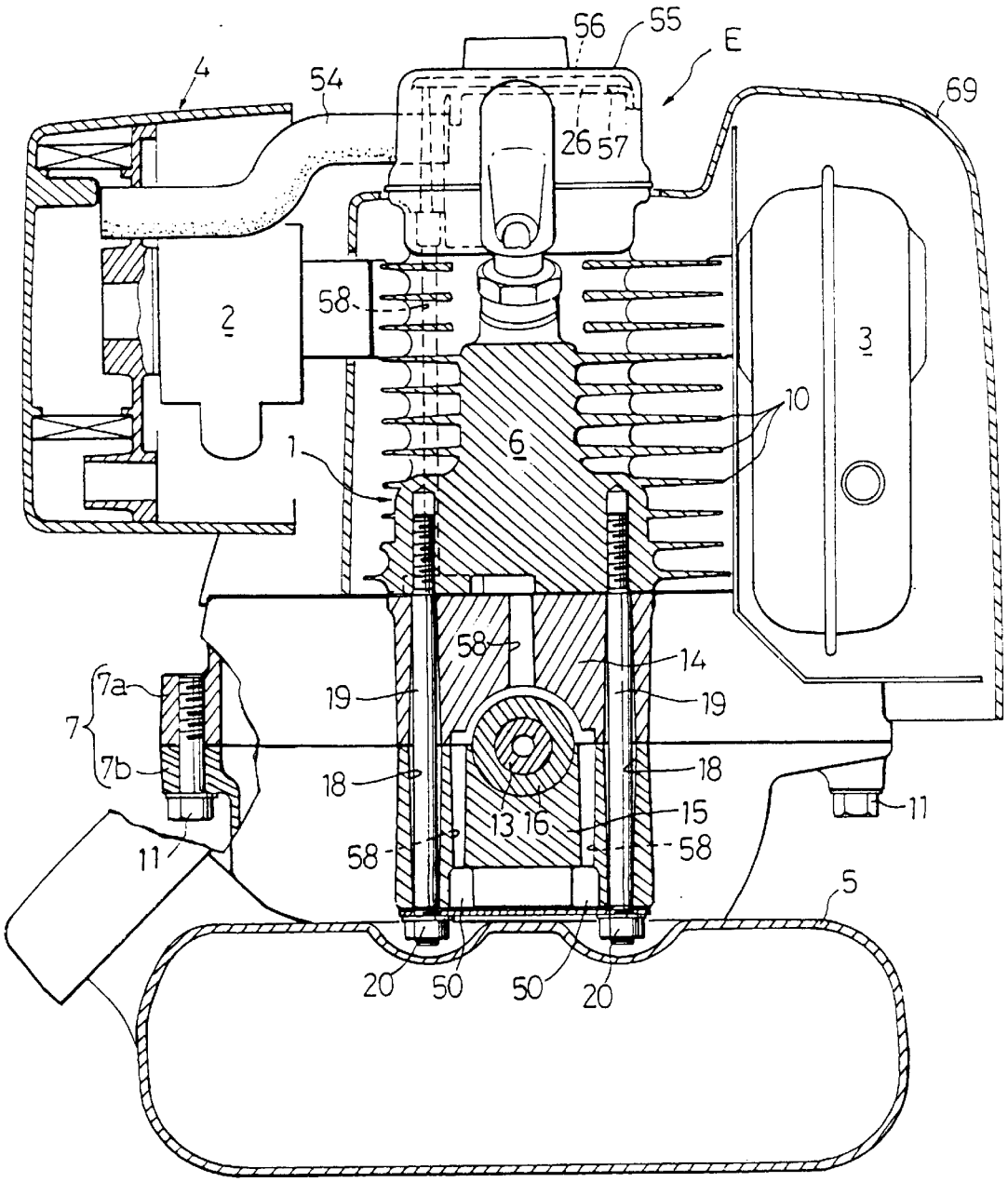

Referring to FIGS. 2 and 3, a carburetor 2 and an exhaust muffler 3 are mounted in front and rear portions of an engine body 1 of the engine E, and an air cleaner 4 is mounted in an inlet of an intake passage in the carburetor 2. A fuel tank 5 is mounted to a lower surface of the engine body 1. The carburetor 2 includes a diaphragm pump for pumping fuel from the fuel tank 5 by utilizing a pressure pulsation in a crank chamber (which will be described hereinafter) of the engine E to circulate the surplus fuel to the tank 5, so that the fuel can be supplied to an intake port in the engine E in any attitude.

As shown in FIGS. 2 and 3, the engine body 1 includes a cylinder block integral with a head, and a crankcase 7 bonded to a lower end face of the cylinder block 6. The cylinder block 6 includes a single cylinder 9 having a piston 8 received therein, and a large number of cooling fins 10 around its outer periphery.

The crankcase 7 includes a pair of upper and lower case halves 7*a* and 7*b* coupled to each other by a plurality of bolts 11 arranged in their peripheral edges. A crankshaft 13 is connected to the piston 8 through a connecting rod 12 and supported between the case halves 7*a* and 7*b* in the following manner:

The upper case half 7*a* is integrally provided with a pair of left and right upper journal support walls 14 and 14' depending from a ceiling wall, and the lower case half 7*b* is integrally provided with a pair of left and right lower journal support walls 15 and 15' rising from its bottom wall and opposed to the upper journal walls 14 and 14'. A left journal portion of the crankshaft 13 is clamped between the left upper and right journal support walls 14 and 15 with a plane bearing 16 interposed therebetween, and a right journal portion of the crankshaft 13 is clamped between the right upper and lowerjournal support walls 14' and 15' with a ball bearing 17 interposed therebetween. A total of four bolt bores 18 are made in each of the upper and lower journal support walls 14' and 15' in an arrangement on opposite sides of the plane bearing 16 or the ball bearing 17, and vertically passed through the crankcase 7. Four stud bolts 19 are embedded in a lower end face of the cylinder block 6 and passed through the bolt bores 18. A nut 20 is threadedly fitted over a lower end of each of the stud bolts 19 protruding from a lower surface of the crankcase 7. In this manner, the upper and lower journal support walls 14, 14', and 15, 15' are coupled to each other, and the cylinder block 6 and the crankcase 7 are also coupled to each other.

Such coupling structure does not interfere with the cooling fins 10 provided around the outer periphery of the cylinder block 6 and hence, the number, the extent and the like of the cooling fins 10 can be freely selected, and the cooling effect for the engine can be enhanced sufficiently. The support rigidity of the crankcase 7 to the crankshaft 13 can be also enhanced.

Oil seals 21 and 21' are mounted at opposite end walls of the crankcase 7 at portions through which the crankshaft 13 is passed.

The inside of the crankcase 7 is divided into a left oil reservoir chamber 22, a central crank chamber 23 and a right valve-operating chamber 24, as viewed in FIG. 2. A crank portion 13*a* of the crankshaft 13 is disposed in the crank chamber 23. A defined amount of lubricating oil O is stored in the oil reservoir chamber 22, and an oil slinger 25 (which is an oil mist generating means) for agitating and scattering the lubricating oil O is secured to the crankshaft 13.

Figure 4:
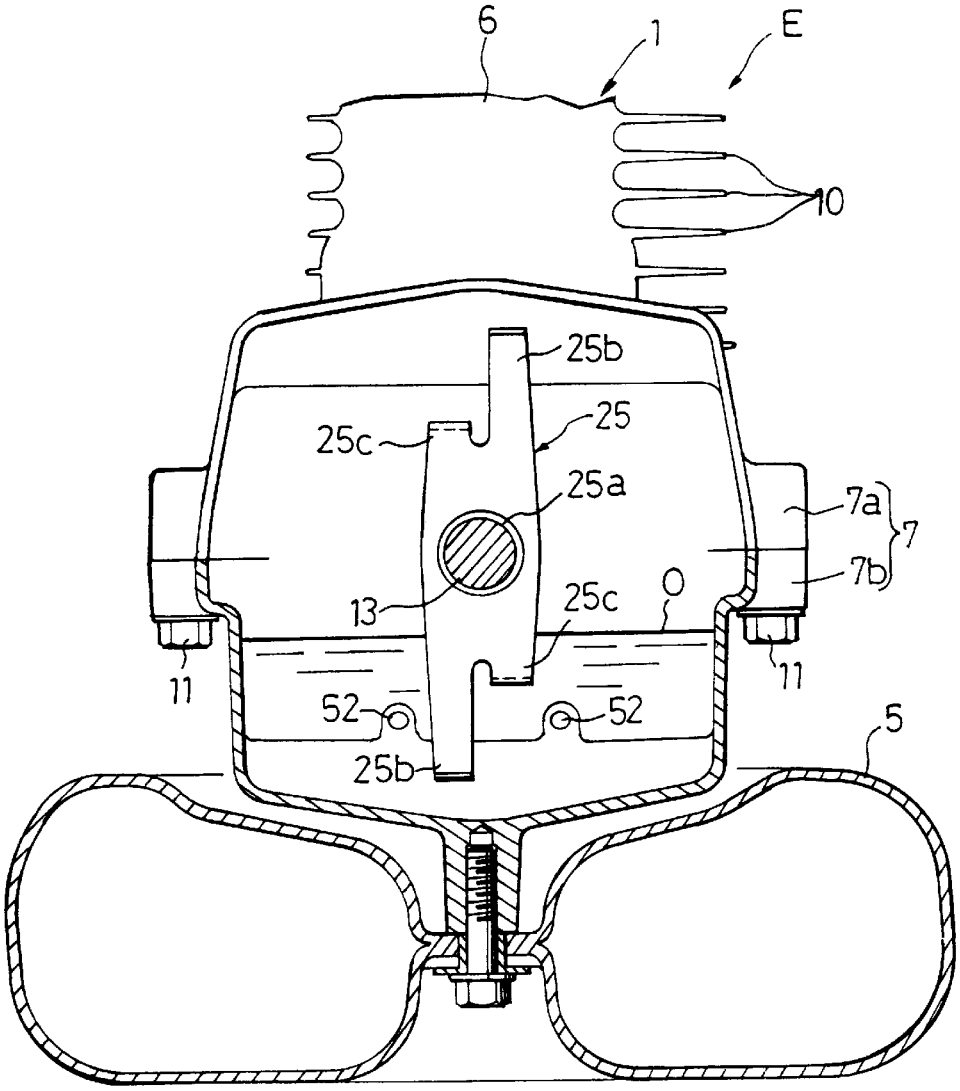

As shown in FIGS. 2 and 4, the oil slinger 25 includes a boss 25*a* fitted over the crankshaft 13, a plurality of longer-arm blades 25*b* and a plurality of shorter-arm blades 25*c* both protruding from an outer periphery of the boss 25*a*. Tip ends of the blades 25*b* and 25*c* are bent in axially opposite directions.

The oil slinger 25 having such structure is capable of agitating the oil stored in the oil reservoir chamber 22 by the rotation of both the blades 25*b* and 25*c* in any operational attitude of the engine E to produce an oil mist at all times.

The valve-operating chamber 24 extends through one side of the cylinder block 6 to the head of the cylinder block 6. An upper portion or the valve-operating chamber 24 is capable of being opened and closed by a head cover 26 coupled to the head of the cylinder block 6.

Figure 5:
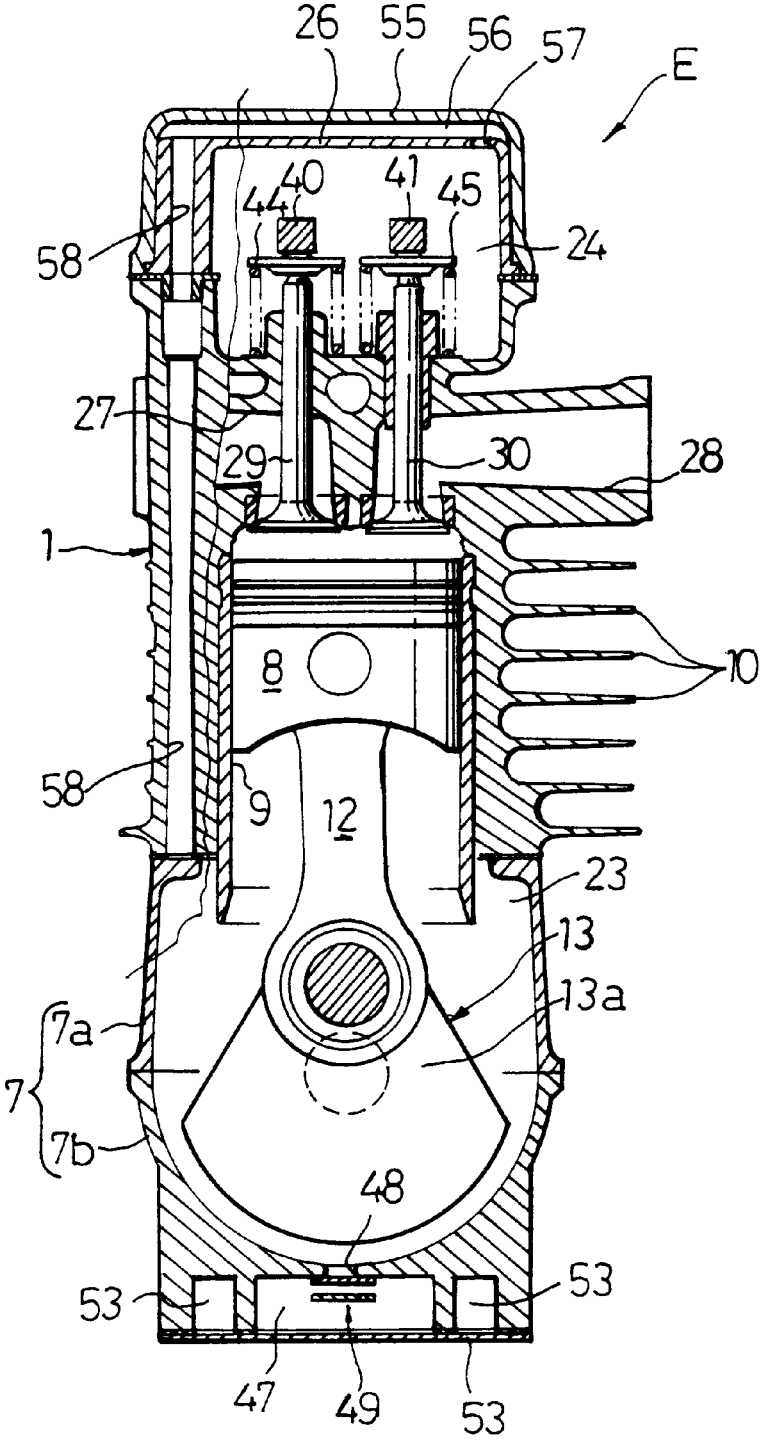
Figure 6:
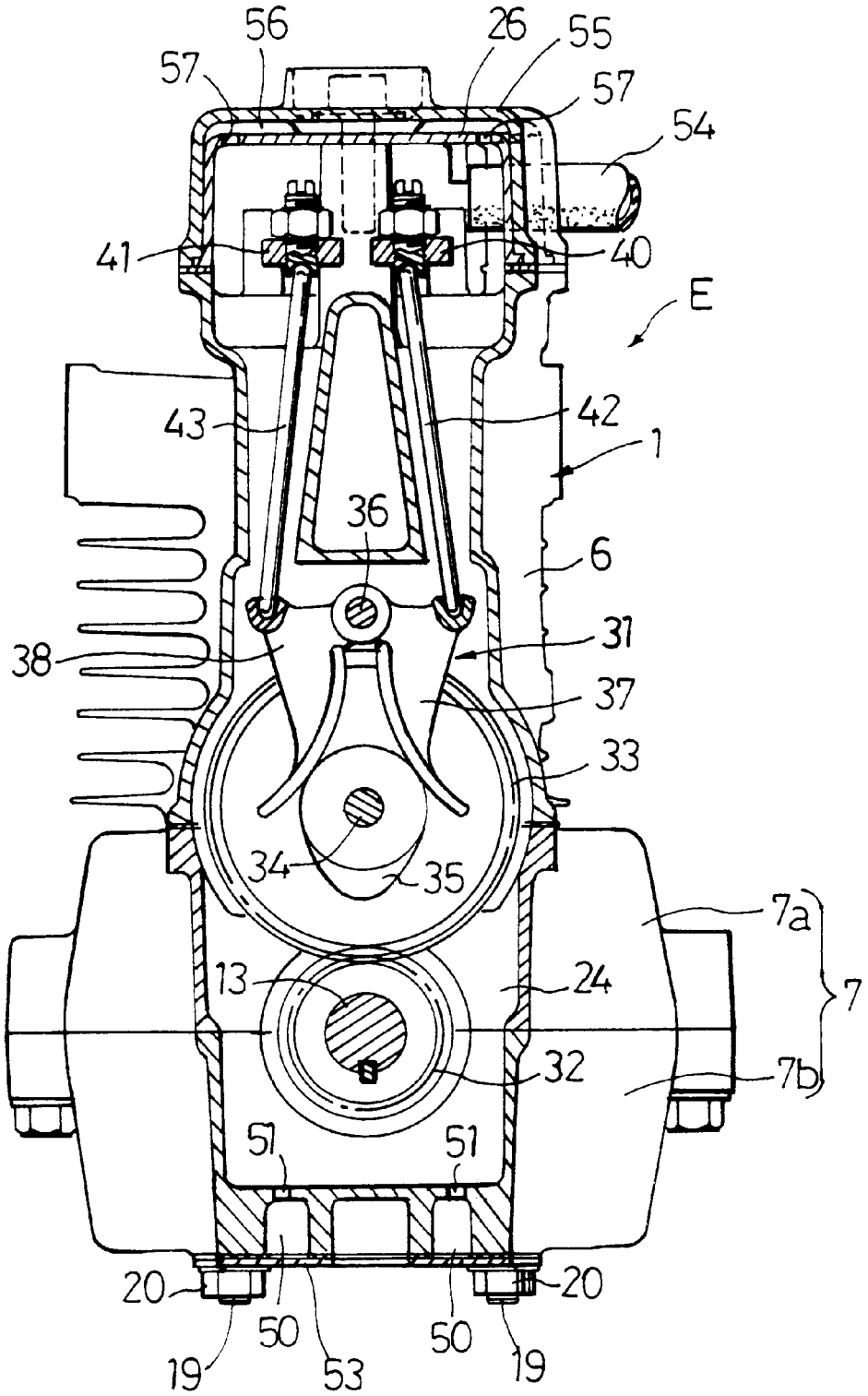

As shown in FIGS. 2 and 5, the head of the cylinder block 6 is provided with exhaust ports 27 and 28 connected to the carburetor 2 and the exhaust muffler 3, and intake and exhaust valves 29 and 30 for opening and closing the intake and exhaust ports 27 and 28. A valve-operating device 31 for opening and closing the intake and exhaust valves 29 and 30 is disposed in the valve-operating chamber 24.

The valve-operating device 31 includes a follower timing gear 33 which is rotatably carried on a support shaft 34 supported between coupled surfaces of the cylinder block and the crankcase 7 and which is driven at a speed-reduction ratio of 2/1 from a driving timing gear 32, a cam 35 integrally connected to one end of the follower timing gear 33, a pair of cam followers 37 and 38 carried on a cam follower shaft 36 mounted in the cylinder block 6, so that they are swung by the cam 35, a pair of rocker arms 40 and 41 carried on a rocker shaft 39 mounted in the head of the cylinder block 6 with their one ends abutting against valve heads of the intake and exhaust valves 29 and 30, a pair of push rods 42 and 43 connecting the can followers 37 and 38 to the other ends of the rocker arms 40 and 41, and valve springs 44 and 45 for biasing the intake end exhaust valves 29 and 30 in closing directions. During an intake stroke of the piston 8, the intake valve 29 can be opened, and during an exhaust stroke of the piston 8, the exhaust valve 30 can be opened.

The oil reservoir chamber 22 and the crank chamber 23 communicate with each other through a through-hole 46 provided in the crank shaft 13. In this case, an opening of the through-hole into the oil reservoir chamber 22 is disposed at a center portion of the oil reservoir chamber 22. The amount of lubricating oil O stored in the oil reservoir chamber 22 is set so that the opening is submerged into the oil even in any inclined or inverted state of the engine. Alternatively, the through-hole 46 may be provided in the plane bearing 16 or a partition wall between the oil reservoir chamber 22 and the crank chamber 23.

Figure 7:
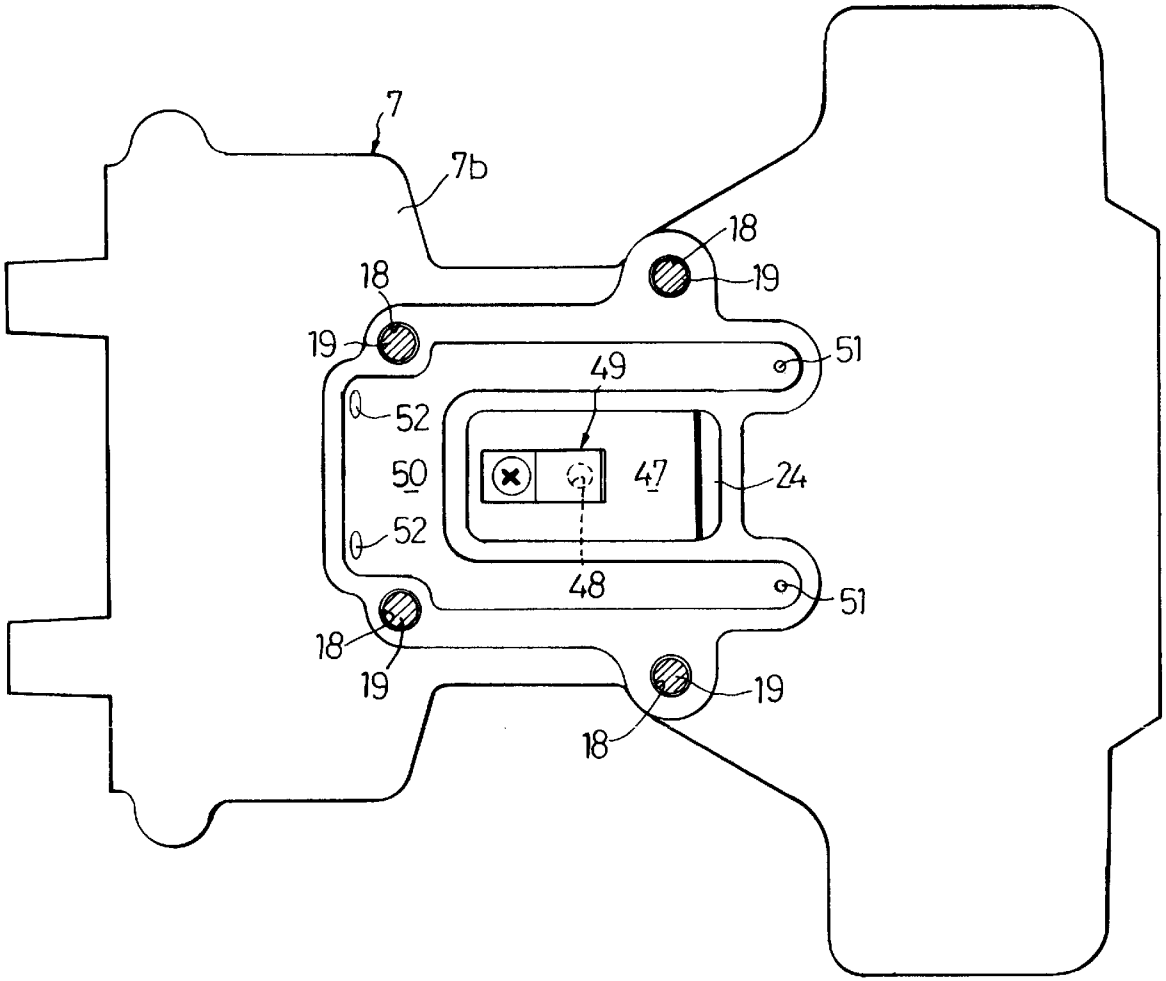

As shown in FIGS. 2 and 7, a valve chamber 47 is defined under a lower surface of the crankcase 7 and connected to the valve-operating chamber 24. The valve chamber 47 communicates with a bottom of the crank chamber 23 through a valve bore 48. A one-way valve 49 is mounted in the valve chamber 47 as a control valve for opening and closing valve bore 48 and is moved in response to the pressure pulsation in the crank chamber 23, so that the valve bore 48 is closed upon a reduction in pressure and opened upon a pressure rise.

A U-shaped oil return chamber 50 is defined under the lower surface of the crankcase 7 to surround the valve chamber 47. The oil return chamber 50 communicates with the bottom of the valve-operating chamber 24 through a pair of orifices 51 disposed spaced apart from each other to the utmost, and also communicates with the oil reservoir chamber 22 through the pair of through-hole 46. The total sectional area of the through holes 46 is set sufficiently larger than the total sectional area of the orifices 51.

The valve chamber 47 and the oil return chamber 50 are defined by closing a recess defined in the lower surface of the crankcase 7 by a bottom plate 53. The bottom plate 53 is clamped to the crankcase 7 by the stud bolts 19 and the nuts 20.

An upper portion of the valve-operating chamber 24 communicates with an inside of the air cleaner 4 through a breather tube 54 made of rubber and mounted through one-side wall of the head cover 26. In this case, that end of the breather tube 54 which is opened into the valve-operating chamber 24 is disposed to protrude into the valve-operating chamber 24 over a predetermined length. Therefore, the oil somewhat accumulated in the valve-operating chamber 24 can be prevented from flowing out of the chamber 24 into the breather tube 54 in any operational attitude of the engine E.

Figure 8:
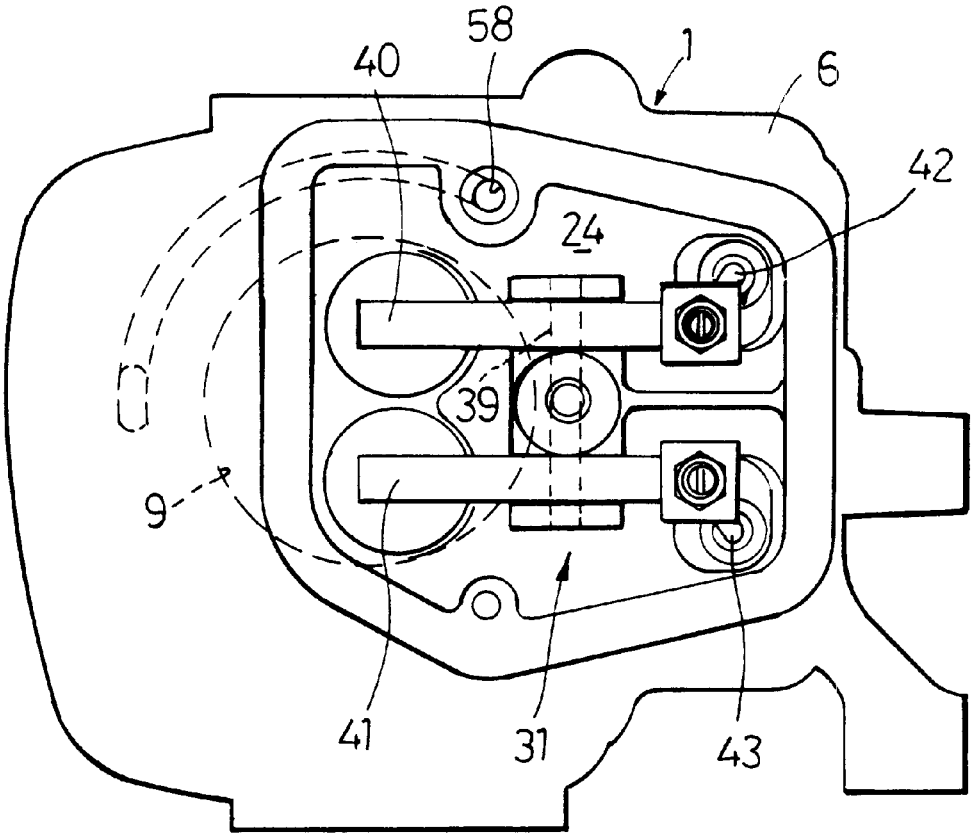
Figure 9:
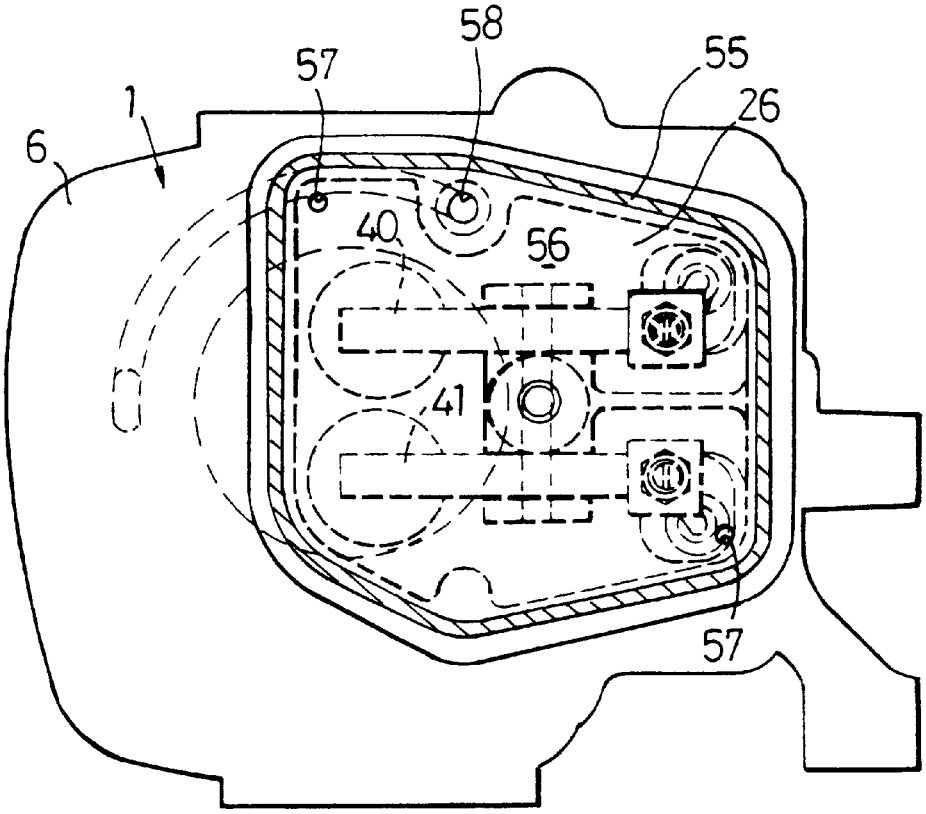

As shown in FIGS. 2, 8 and 9, an outer cover 55 is coupled to the head cover 26, so that it is fitted over an outer periphery of the head cover 26. A flat uppermost chamber 56 is defined between ceiling walls of the covers 26 and 55 and communicates with the valve-operating chamber 24 through a pair of orifices 57 provided in the ceiling wall of the head cover 26 at diagonal locations (desirably at four corners). The uppermost chamber 56 also communicates with the oil return chamber 50 through a single oil passage 58 provided in the cylinder block 6 and the crankcase 7. The oil passage 58 has a sectional area larger than the total sectional area of the pair of orifices 57.

Figure 10A:
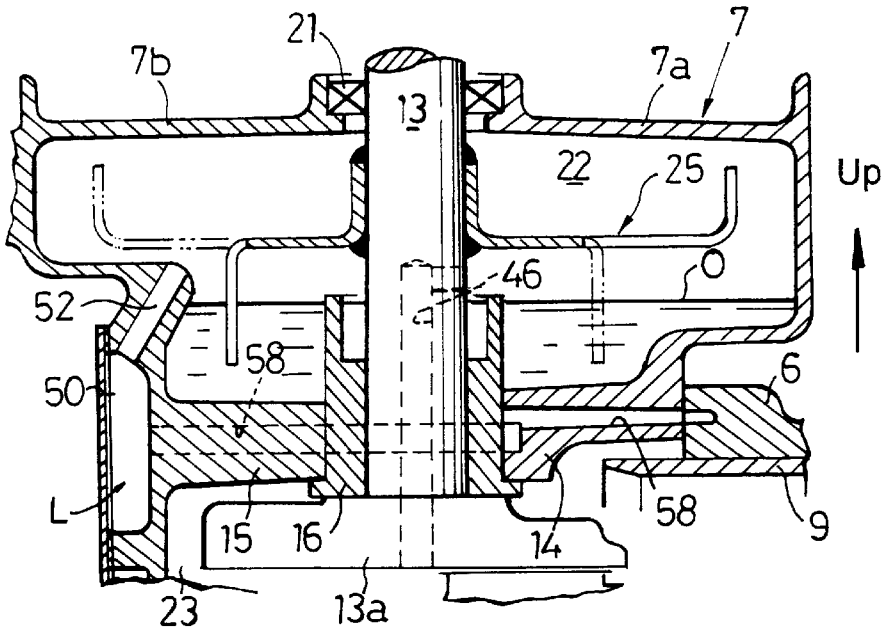
FIGS. 10A and 10B are sectional views illustrating the position between a level of oil stored in an oil reservoir chamber and a circulating passage in a sideways fallen state (10A) and a turned upside-down or inverted state (10B) of the engine.
Figure 10B:
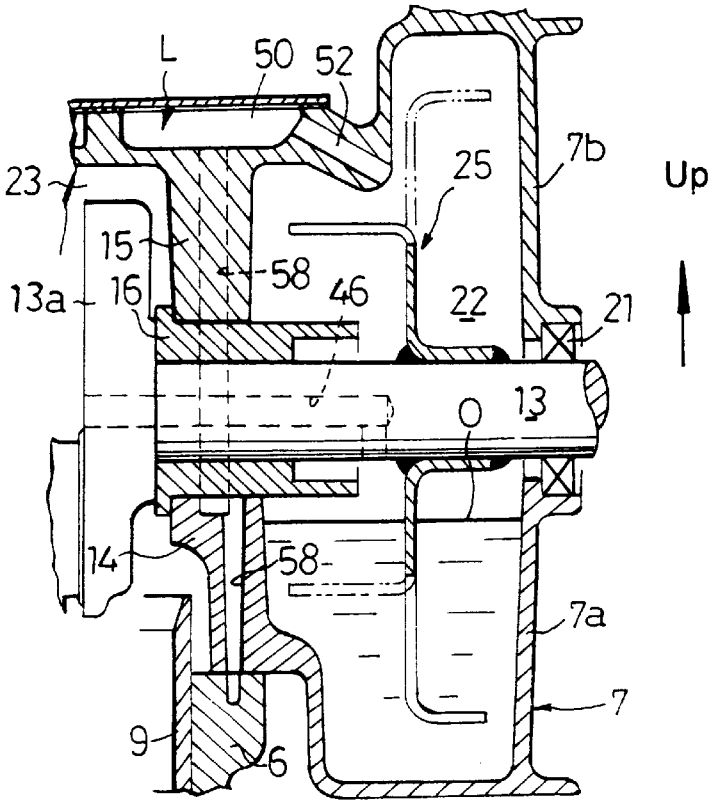

The orifices 51 and 57, the uppermost chamber 56, the oil passage 58, the oil return chamber 50 and the through-holes 46 constitute a circulating passageway L for returning the lubricating oil from the valve-operating chamber 24 to the oil reservoir chamber 22. An opening 52 of the circulating passageway into the oil reservoir chamber 22, i.e. an outlet end of the through-hole 52 is located at a longitudinally and laterally central portion of the oil reservoir chamber 22 and below a vertically central portion of the oil reservoir chamber 2 and below a vertically central portion of the chamber 22. Thus, as shown in FIGS. 10A and 10B, such opening is exposed above the stored oil level in the oil reservoir chamber 22 in a sideways-fallen or inverted state of the engine E in which the valve-operating chamber 24 is located below the oil reservoir chamber 22.

If the rotation of the crankshaft 13 causes the lubricating oil O to be agitated in the oil reservoir chamber by the oil slinger 25 during operation of the engine E to produce an oil mist, when the pressure in the crank chamber is reduced by the elevating movement of the piston 8, the oil mist is drawn through the through-holes 46 into the crank chamber 23 to lubricate portions around the crank portion 13*a* and the piston 8. Then, when the pressure in the crank chamber 23 increases by the lowering movement of the piston 8, the one-way valve 49 is opened to permit the oil mist to be supplied along with blow-by gas generated in the crank chamber 23 from the valve bore 48 into the valve chamber 47 and thus into the valve operating chamber 24, where the oil mist and the blow-by gas are separated from each other. Thus, the oil mist lubricates the various portions of the valve-operating device 31, while the blow-by gas is discharged through the breather tube 54 into the air cleaner 4.

The pressure in the crank chamber 23 is pulsated by the elevating and lowering movements of the piston 5 between positive and negative pressures alternately repeated. Under the positive pressure, the one-way valve 49 is opened to permit the positive pressure to be released toward the valve chamber 47. Under the negative pressure, the one-way valve 49 is closed to inhibit the back-flow of the positive pressure from the valve chamber 47 and hence, the pressure in the crank chamber 23 is kept negative on an average.

On the other hand, the valve-operating chamber 24 and the valve chamber 47 connected to each other communicate with the inside of the air cleaner 4 which is in an atmospheric pressure state, through the breather tube 54 and hence, the pressures in both the chambers 24 and 47 are substantially equal to atmospheric pressure.

The oil reservoir chamber 22 communicates with the crank chamber 23 through the through-holes 46 and hence, the pressure in the oil reservoir chamber 22 is equal to or slightly higher than the pressure in the crank chamber 23.

The oil return chamber 50 communicates with the oil reservoir chamber 22 through the through-hole 52 and also with the valve-operating chamber 24 through the orifices 51 and hence, the pressure in the oil return chamber 50 is equal to or slightly higher than the pressure in the oil reservoir chamber 22.

The uppermost chamber 56 communicates with the oil return chamber 50 through the oil passage 58 and also with the valve-operating chamber 24 through the orifices 57 and hence, the pressure in the uppermost chamber 56 is equal to or slightly higher than the pressure in the oil return chamber 50.

The magnitude relationship between the pressures in the chambers can be represented by the following expression:

$$Pc \leq Po \leq Pr \leq Pt < Pv$$

wherein, Pc represents pressure in the crank chamber 23,

Po represents pressure in the oil reservoir chamber 22,

Pr represents pressure in the oil return chamber 50,

Pt represents pressure in the upper most chamber 56, and

Pv represents pressure in the valve-operating chamber 24.

As a result, during operation of the engine, the pressure flows through a path which will be shown below:

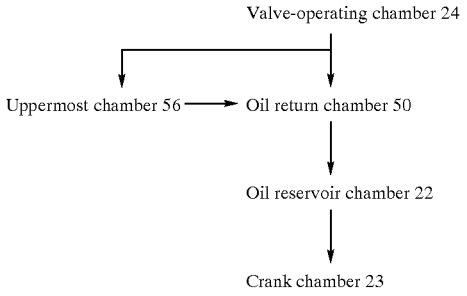

Therefore, the oil mist fed to the valve-operating chamber 24 is circulated via the pressure path to the oil reservoir chamber 22, and the oil liquefied in the valve-operating chamber 24 is circulated via the orifices 51 to the oil return chamber 50 and the oil reservoir chamber 22. Such circulation of the oil mist and the liquefied oil is performed without hindrance even when the engine E is inclined in any attitude.

In the inverted operational state of the engine E, the upper most chamber 56 is located below the valve-operating chamber 24 and hence, the oil liquefied in the valve-operating chamber 24 flows through the orifices 57 into the uppermost chamber 24 and is drawn upwards through the oil passage 58 into the oil return chamber 50 and circulated into the oil reservoir chamber 22.

Even in any operational attitude such as inclined and inverted attitudes of the engine E, the circulation of the lubricating oil can be conducted without interruption to insure a good lubricating state at all times. Therefore, it is possible for the engine to resist the working of the power trimmer T in all directions. Moreover, since the pressure pulsation in the crank chamber 23 is utilized for the circulation of the lubricating oil, the expense of an oil pump is not required.

After completion of the working, the operation of the engine E is stopped to leave the power trimmer to stand, the engine E may fall sideways or be inverted in some cases, as shown in FIGS. 10A and 10B. However, in such a state, the opening of the circulating path L connected to the valve-operating chamber 24 into the oil reservoir chamber 22, i.e., the outlet end of the through-hole 52 is exposed above the oil level of the lubricating oil O stored in the oil reservoir chamber 22 and hence, the lubricating oil O in the oil reservoir chamber 22 can be prevented from flowing backwards through the circulating path L into the valve-operating chamber 24. Therefore, it is possible to avoid the leakage of the lubricating oil from the valve-operating chamber 24 into the breather tube 54.

Referring again to FIG. 2, a rotor 61 of a flywheel magneto 59 with a cooling blade 60 is secured to an outer end of the crankshaft 13 adjacent the valve-operating chamber 24, and an ignition coil 62 cooperating with the rotor 61 is secured to the cylinder block 6. A centrifugal clutch 64 is interposed between the rotor 61 and a working machine driving shaft 63. The centrifugal clutch 64 includes a plurality of clutch shoes 65 expandably carried on the rotor 61, a clutch spring 66 for biasing the clutch shoes 65 in a contracting direction, and a clutch drum 67 secured to the driving shaft 63 to surround the clutch shoes 65. When the rotor 61 is rotated in a predetermined number of rotations or more, the clutch shoes 65 are expanded to come into pressure contact with an inner peripheral surface of the clutch drum 67, thereby transmitting an output torque from the crankshaft 13 to the driving shaft 63.

A shroud 69 is mounted to the engine body 1 to cover the head portion of the engine body 1 and the flywheel magneto 59 and to define a cooling air passage 68 between the shroud and the head portion of the engine body 1 and the flywheel magneto 59. An inlet 68*i* into the cooling air passage 68 is mounted in an annular configuration between the centrifugal clutch 64 and the shroud 69, and an outlet 68*o* is mounted in the shroud 69 on the opposite side from the inlet 68I.

Thus, during rotation of the rotor 61, wind produced by the cooling blade 60 flows through the cooling air passage 68 to cool the various portions of the engine E.

The oil reservoir chamber 22 adjoining one side of the crank chamber 23 is disposed to protrude from the outer surface of the cylinder block 6 to face the cooling air passage 68, and a known coil starter 70 capable of cranking the crankshaft 13 is mounted to the outer surface of the crankcase 7 adjacent the oil reservoir chamber 22. The starter 70 is disposed to protrude to the outside of the shroud 69, so that the shroud 69 does not interfere with operation of a starter rope of the starter 70.

When the rotor 61 is rotated along with the crankshaft 13, wind produced by the cooling blade 60 flows through the cooling air passage 68 to cool the various portions of the engine E, but particularly, since the oil reservoir chamber 22 faces the cooling air passage 68, the oil reservoir chamber 22 is also cooled by the cooling air, whereby the cooling of the lubricating oil O can be effectively performed. Moreover, the oil reservoir chamber 22 is disposed in a space between the crank chamber 23 and the recoil-type starter 70, which is conventionally a dead space,and hence, the size of the engine E is not increased by the presence of the oil reservoir chamber 72.

Figure 11:
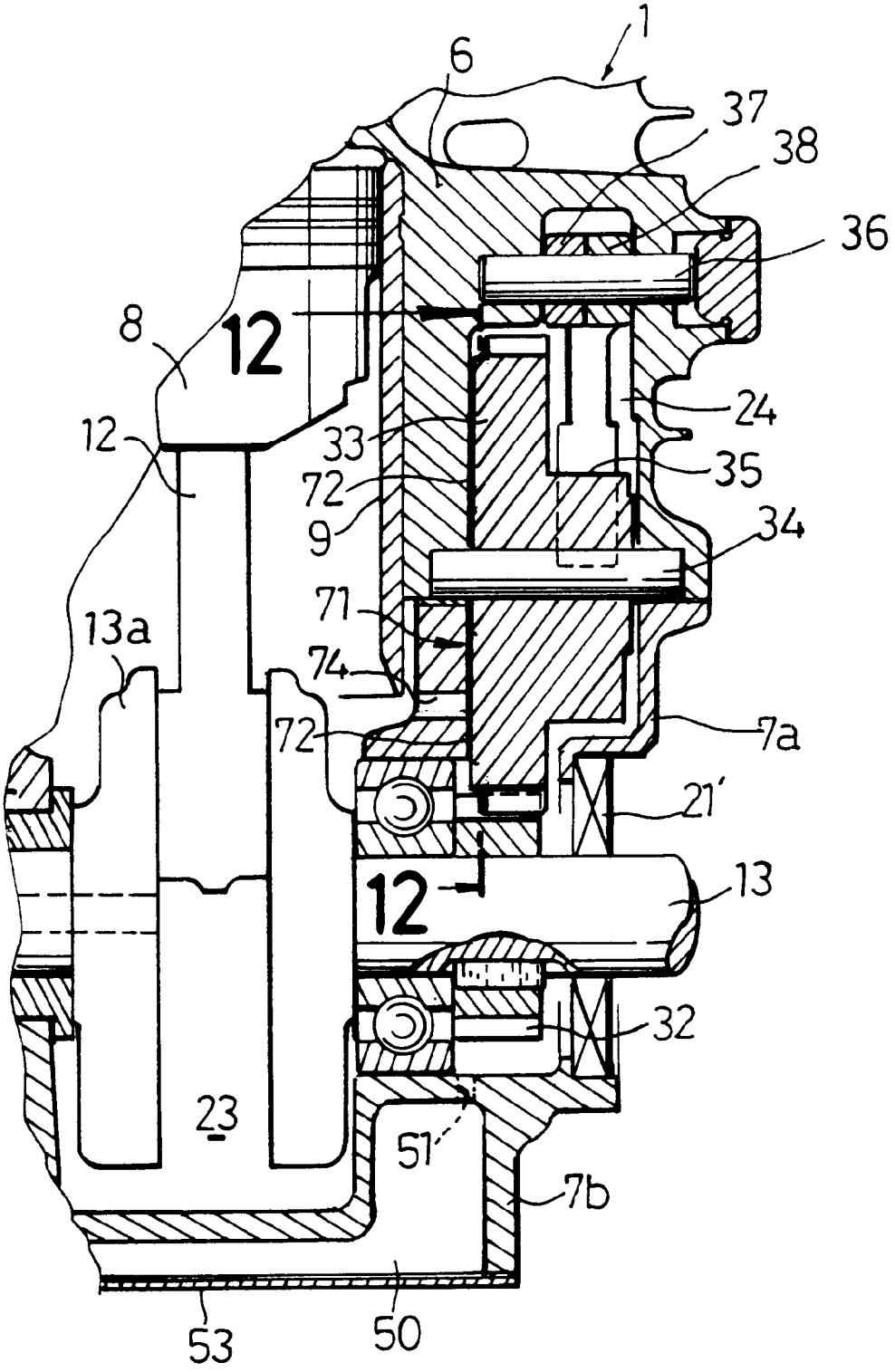
Figure 12:
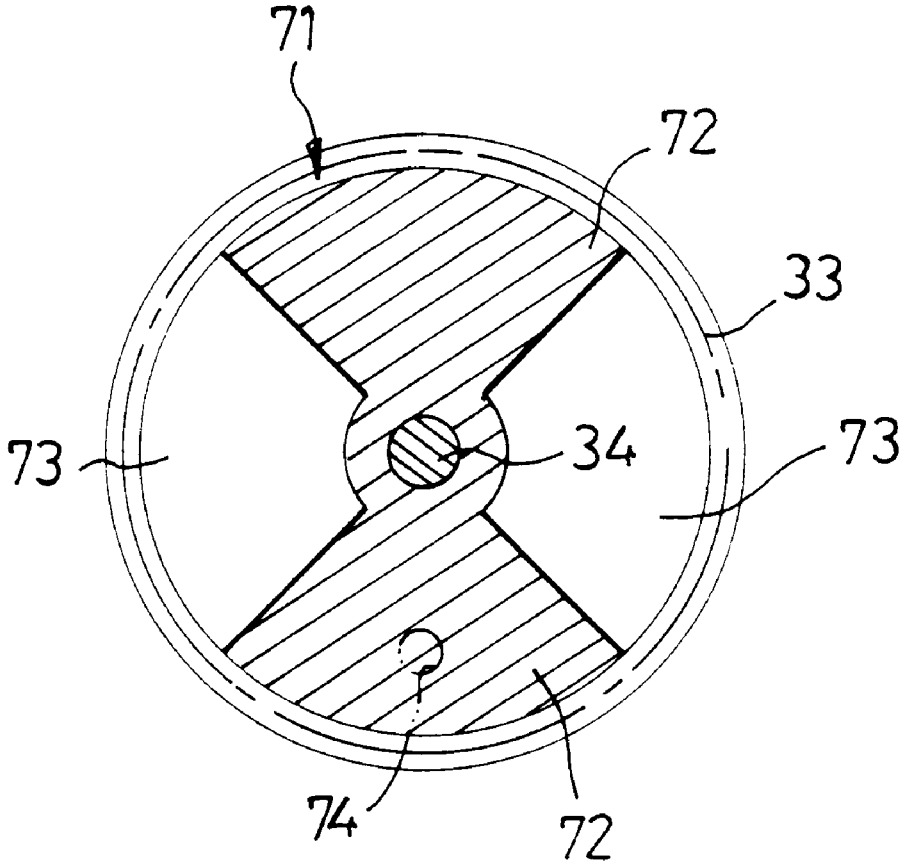
Figure 13:
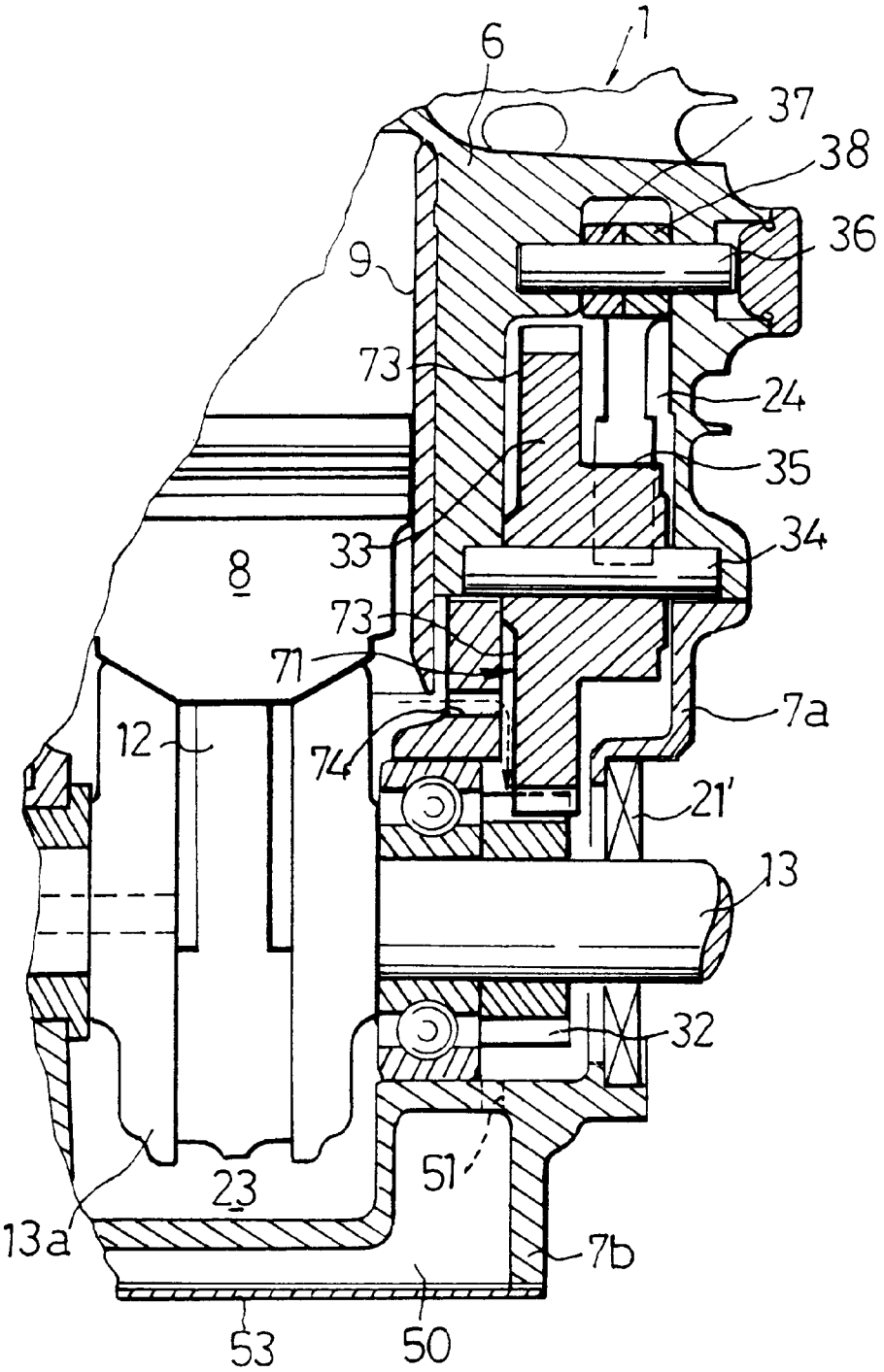

FIGS. 11 to 14 show a modification to the engine, which employs a rotary valve 71 in place of the one-way valve 49. In FIGS. 11 to 13, the rotary valve 71 includes a pair of fan-shaped valve members 72 formed in a bulged manner on an opposite side of the follower timing gear 33 of the valve-operating devise 31 from the cam 35 and arranged on a diametrical line, and a pair of recesses 73 circumferentially located between the valve members 72. The rotary valve 71 is opposed to a valve bore 74 provided in a partition wall between the crankshaft chamber 23 and the valve-operating chamber 24 to open and close the valve bore 74 by the rotation of the follower timing gear 33.

Each of the valve members 72 and the recesses 73 has a center angle of approximately 90°, but because the follower timing gear 33 is driven with a reduction ratio of 1/2 from the driving gear 32 rotated in unison with the crankshaft 13, each of the durations of closing and opening of the valve bore 74 by the valve members 72 and the recesses 73 is of approximately 180° in terms of a crank angle.

Figure 14:
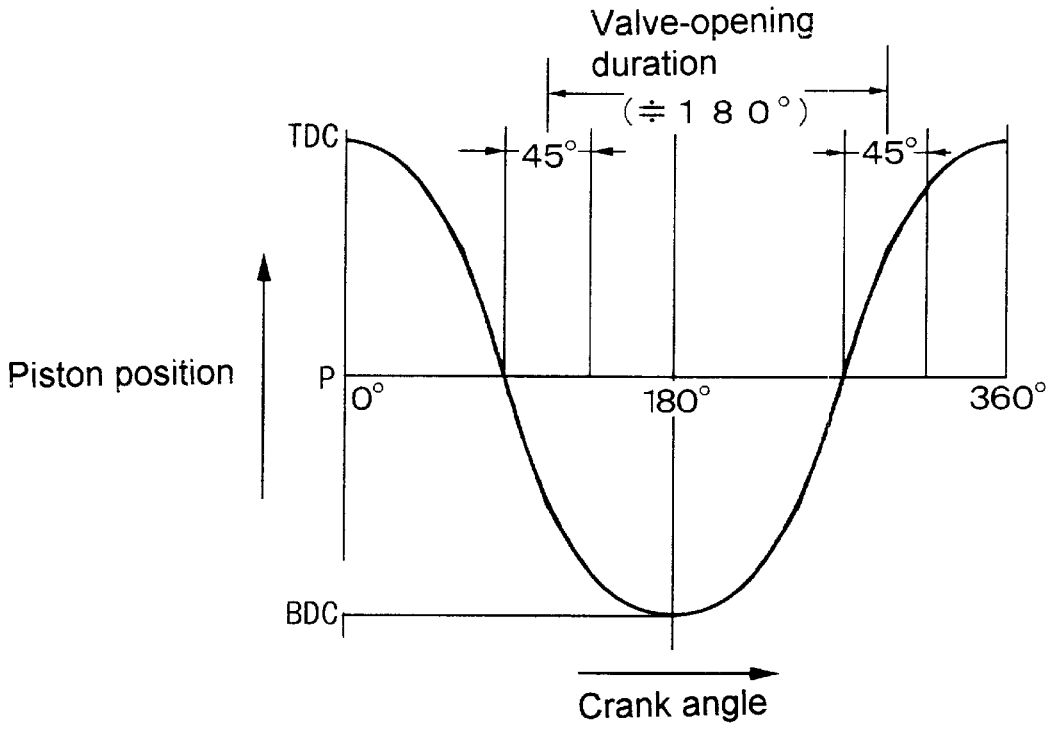

Moreover, as shown in FIG. 14, the valve member 72 and the recess 73 are disposed so that they cause the valve to be opened (see FIG. 13) during the lowering stroke of the piston 8 and to be closed (see FIG. 11) during the elevating stroke of the piston 8. Particularly, a desirable disposition is such that the valve bore 74 is opened in a range of from the middle point P between top and bottom dead points of the piston 8 to a lowering-piston position corresponding to 45° in terms of the crank angle, and closed in a range of from such middle point P to an elevating-piston position of 45' in terms of the crank angle.

Other arrangements are similar to those in the above described embodiment, except that the valve chamber 47 is eliminated, and in FIGS. 11–14, portions or components corresponding to those in the above-described first embodiment are designated by like reference characters.

The rotary valve 71 opens and closes the valve bore 74 in mechanically operative association with the rotation of the crankshaft 13 and hence, even during rotation of the engine E at a high speed, a deviation in a predetermined timing for opening and closing the valve bore 74 cannot be produced, and by effectively utilizing in inertial effect of the flowing gas, the oil mist can be efficiently supplied from the crank chamber 23 into the valve-operating chamber 24 and at the same time, an average negative pressure state of the crank chamber 23 can be insured.

A second embodiment of the present invention will now be described with reference to FIGS. 15 to 25.

Figure 15:
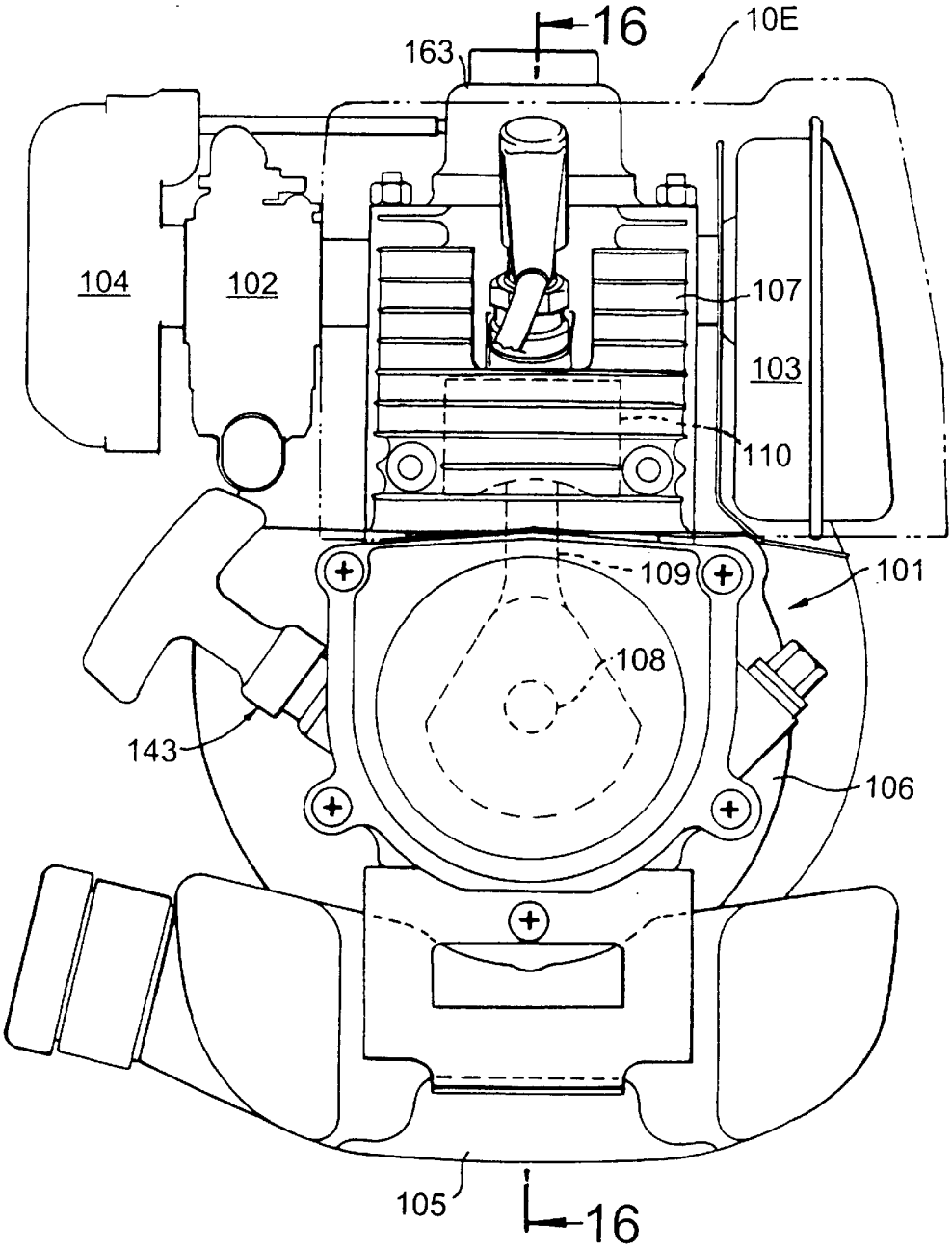

Referring to FIG. 15, a carburetor 102 and an exhaust muffler 103 are mounted to front and rear portions of an engine body 101 of a hand-held type 4-cycle engine 10E, respectively, and an air cleaner 104 is mounted at an intake inlet of the carburetor 102. A fuel tank 105 is mounted to a lower surface of the engine body 101. The carburetor 102 includes a diaphragm pump for pumping fuel from the fuel tank 105 by utilizing a pressure pulsation in a crank chamber which will be described and for circulating the surplus fuel to the fuel tank, so that the fuel can be supplied to an intake port of the engine 10E in any attitude of the engine.

Referring to FIGS. 16, 17, 19 and 20, the engine body 101 includes a crankcase 106 comprised of a pair of left and right case halves 106*a* and 106*b* coupled to each other by bolts, and an integral head-type cylinder block 107 bolted to an upper end face of the crank case 106. The case halves 106*a* and 106*b* carry a crankshaft 108 horizontally, and a piston 110 is connected to a crank pin of the crankshaft 108 through a connecting rod 109 and slidably received in a cylinder 107*a* which is defined in the cylinder block 107.

A top wall of the cylinder 107*a* includes intake port 111 and an exhaust port 112 defined therein and connected to the carburetor 102 and the exhaust muffler 103, and intake and exhaust valves 113 and 114 provided therein for opening and closing the intake and exhaust ports 111 and 112. A valve-operating device 115 for driving the intake and exhaust valves 113 and 114 is disposed in a valve-operating chamber 116 which is defined to extend from the crankcase 106 and the side of the cylinder block 107 to the top of the cylinder block 107. The valve-operating chamber 116 is capable of being opened and closed by a head cover 121 coupled to the head of the cylinder block 107.

The valve-operating device 115 includes a driving timing gear 117 secured to the crankshaft 108, a follower driving gear 118 which is carried on a support shaft 119 mounted to the crankcase 106 at an intermediate portion of the valve-operating chamber 116 and which is driven at a reduction ratio of 1/2 from the driving timing gear 117, a cam 120 integrally connected to one end of the follower timing gear 118, a pair of cam followers 123 and 124 carried on a cam follower shaft 122 mounted in the cylinder head 107, a pair of rocker arms 126 and 127 supported by a rocker shaft 125 mounted in the head of the cylinder block 107 with their one ends abutting against valve heads of the intake and exhaust valves 113 and 114, a pair of push rods 128 and 129 which connect the cam followers 123 and 124 to the other ends of the rocker arms 126 and 127, and valve springs 130 and 131 for biasing the intake, and exhaust valves 113 and 114 in a closing direction, so that the intake is opened during an intake stroke of the piston 110 and the exhaust valve 114 is opened during an exhaust stroke of the piston 114.

A crankcase 132 is defined in the crankcase 106 and includes a cylindrical inner chamber 132*a* in which a crank portion 108*a* of the crankshaft 108 is disposed, and an outer chamber 132*b* having a U-shape in section and surrounding the inner chamber 132*a* over from its bottom to its circumferentially opposite sides. An opening 133 is provided in a partition wall 134 between the inner and outer chambers 132*a* and 132*b* at the bottom of the crank chamber 132 and permits the inner and outer chambers 132*a* and 132*b* to communicate with each other.

A lubricating oil O is stored in the bottom of the crank chamber 132, and the amount of lubricating oil stored is set at a value such that the oil surface slightly contacts with an outer periphery of the crank portion 108*a*. An oil dipper 135 is formed at an enlarged end of the connecting rod 109 as an oil mist producing mans for producing an oil mist by agitating and scattering the lubricating oil O during rotation of the crankshaft 108.

Figure 17:
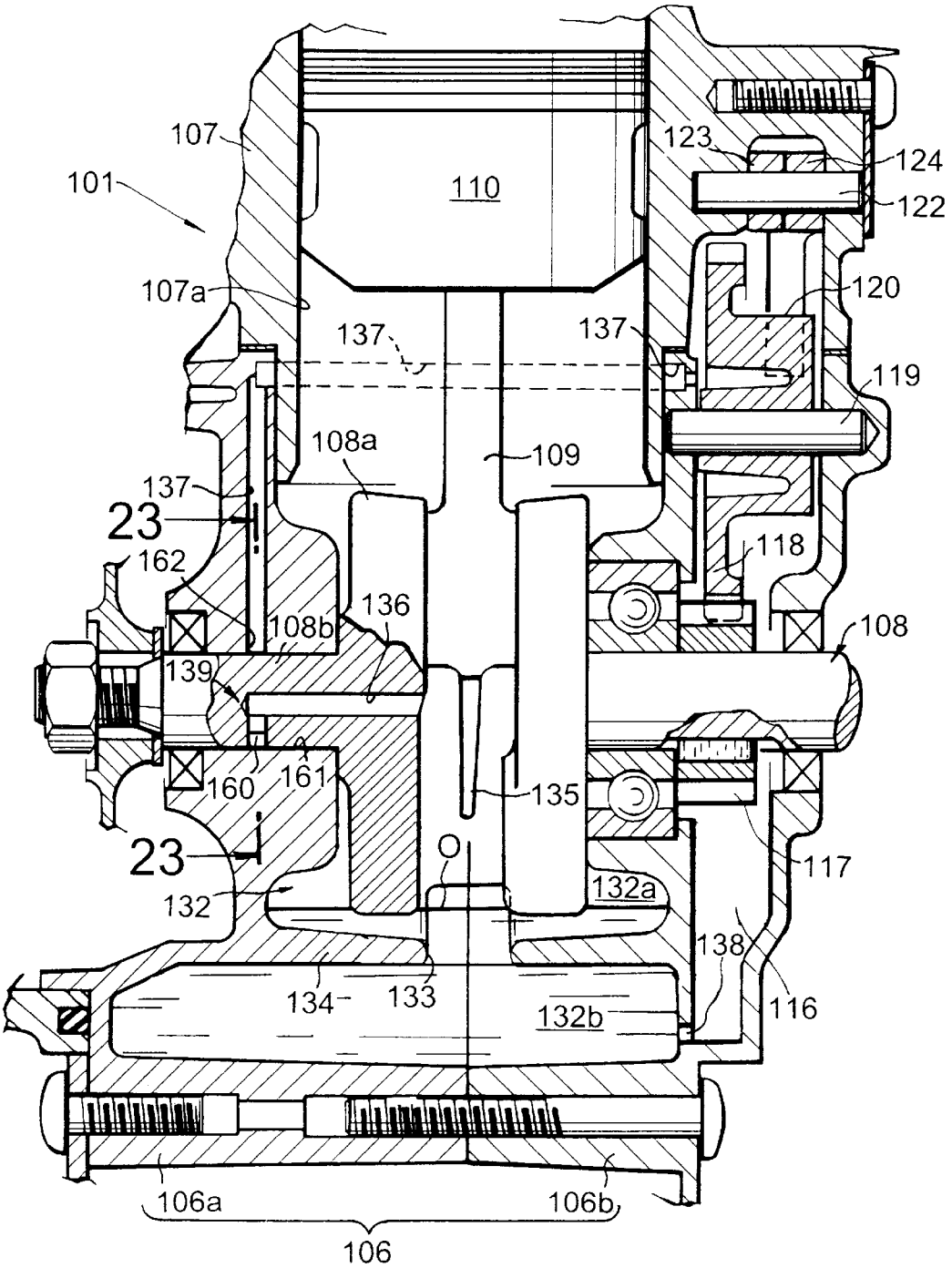
Figure 18:
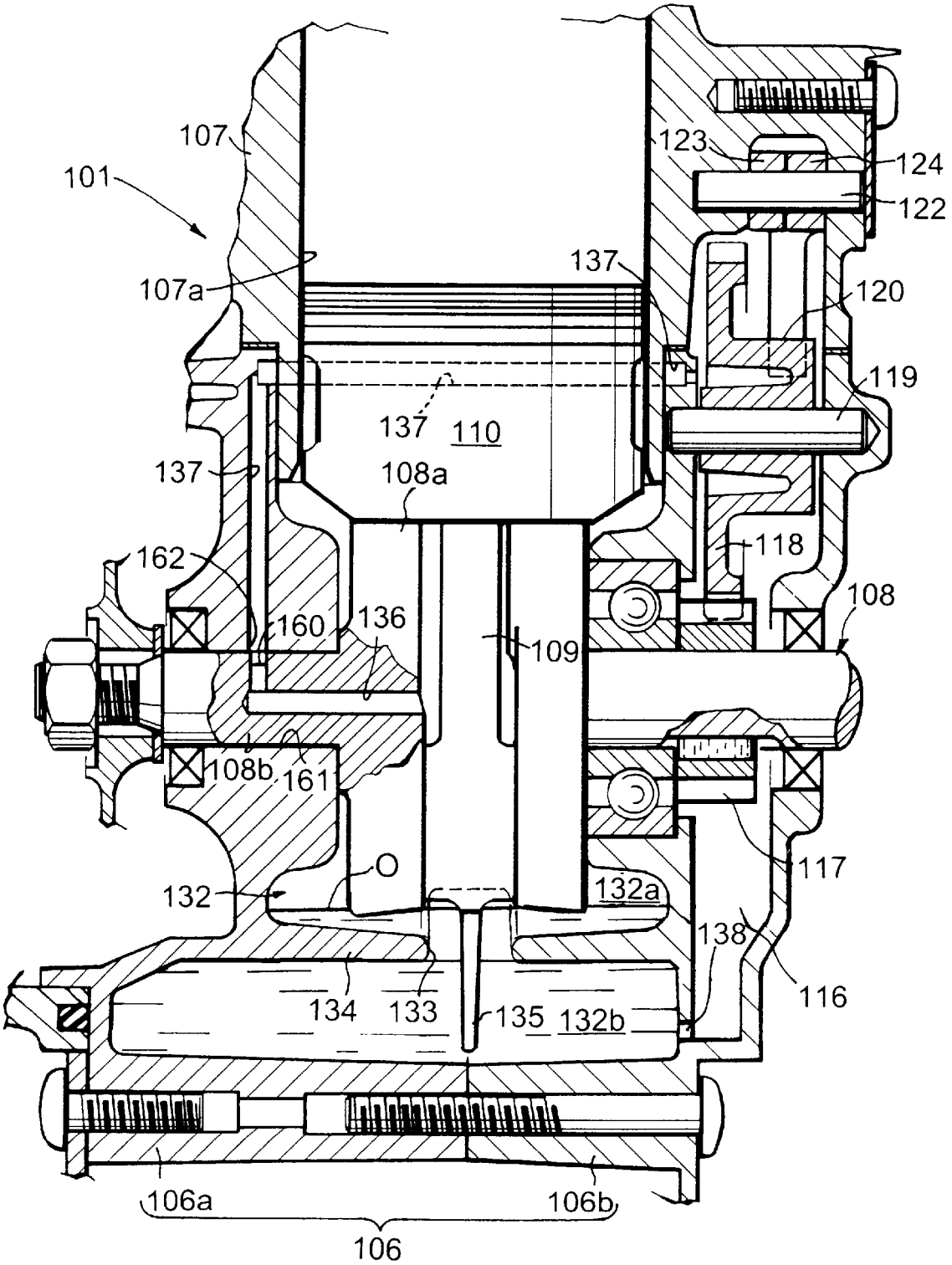
Figure 19:
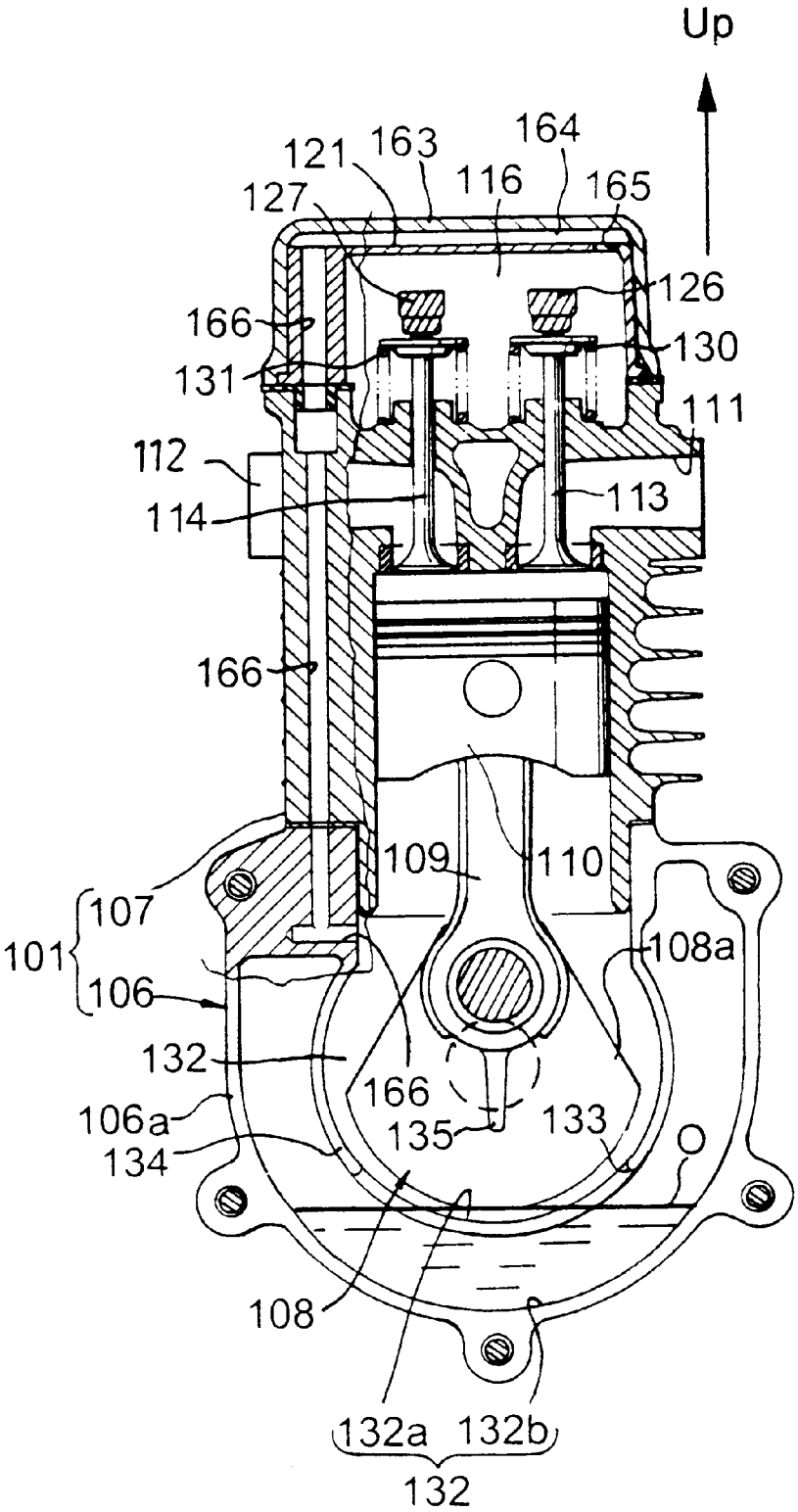
Figure 23:
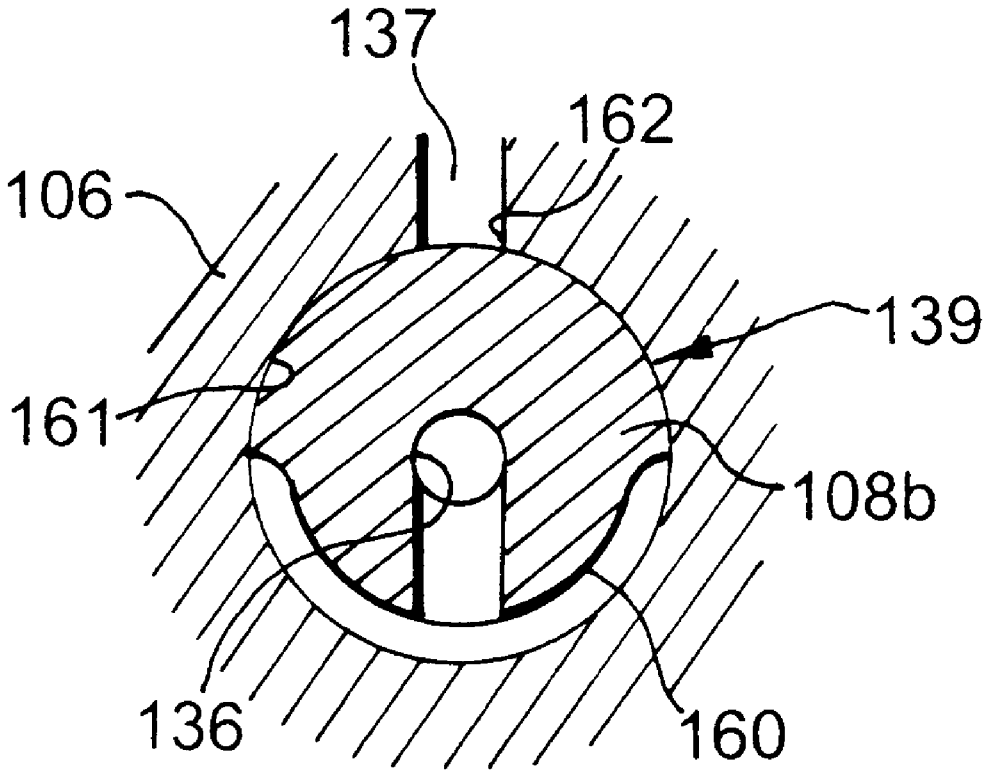

As shown in FIGS. 17 and 23, the crank chamber 132 and the valve-operating chamber 116 communicate with each other through first and second oil supply passages 136 and 137 provided in the crankshaft 108 and the crankcase 106 above the oil level in the crank chamber 132, respectively. The valve-operating chamber 116 also communicates at its bottom with the crank chamber 132 through an orifice 138.

A rotary valve 139 is mounted between the first and second oil supply passage 136 and 137 as a control valve. The rotary valve 139 includes an arcuate groove 160 of approximately 180° made in an outer periphery of a journal portion 108*b* at one side of the crankshaft 108, and a valve bore 162 which is provided in a bearing portion 161 of the crankcase 106 for bearing the journal portion 108*b* to communicate with the arcuate groove 160. The first oil supply passage 136 in the crankshaft 108 is connected to the arcuate groove 160, and the second oil supply passage 137 in the crankcase 106 is connected to the valve bore 162. Thus, every time the crankshaft is rotated through approximately 180° the arcuate groove 160 and the valve bore 162 are brought alternately repeatedly into and out of communication with each other, but the rotary valve is disposed, so that it is opened (see FIG. 18) during a lowering stroke of the piston 110 and closed (see FIG. 17) during a elevating stroke of the piston 110. Particularly, a desirable disposition is such that the opening of the rotary valve is started in a range of from a middle point P between top and bottom dead points of the piston 8 to a lowering-piston position corresponding to 45° in terms of the crank angle, and the opening of the rotary valve is completed in a range of from such middle point P to an elevating-piston position of 45° in terms of the crank angle, as in the above-described modification (see FIG. 14).

Figure 20:
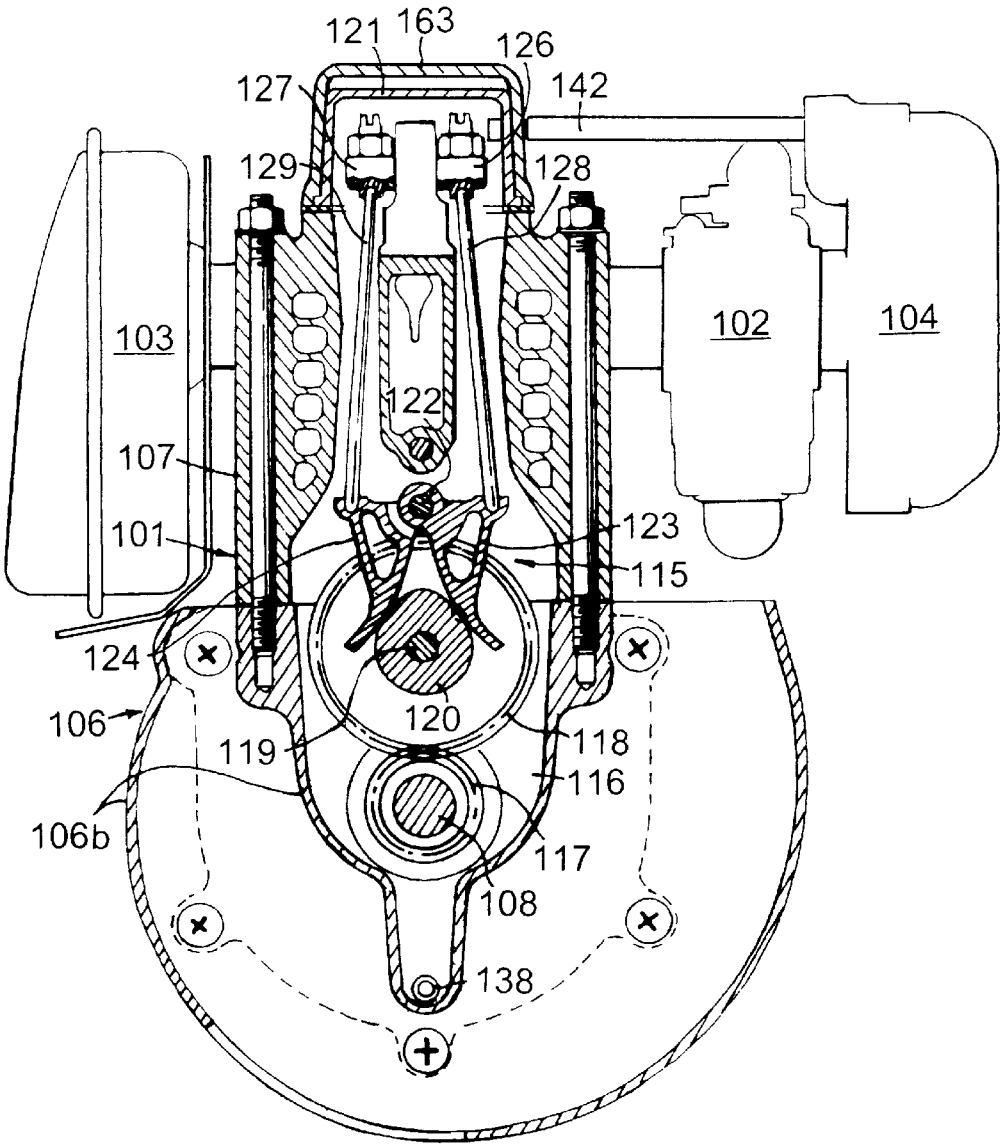

As shown in FIG. 20, an upper portion of the valve operating chamber 124 communicates with the inside of the air cleaner 104 through a breather tube 142 made of a rubber and mounted through one side wall of the head cover 121. In this case, that end of the breather tube 142 which is opened into the valve-operating chamber 116 is disposed to protrude into the valve-operating chamber 116 over a predetermined length. Therefore, the oil somewhat accumulated in the valve-operating chamber 116 can be prevented from flowing out of the chamber 116 into the breather tube 142 in any operational attitude of the engine 10E.

Figure 16:
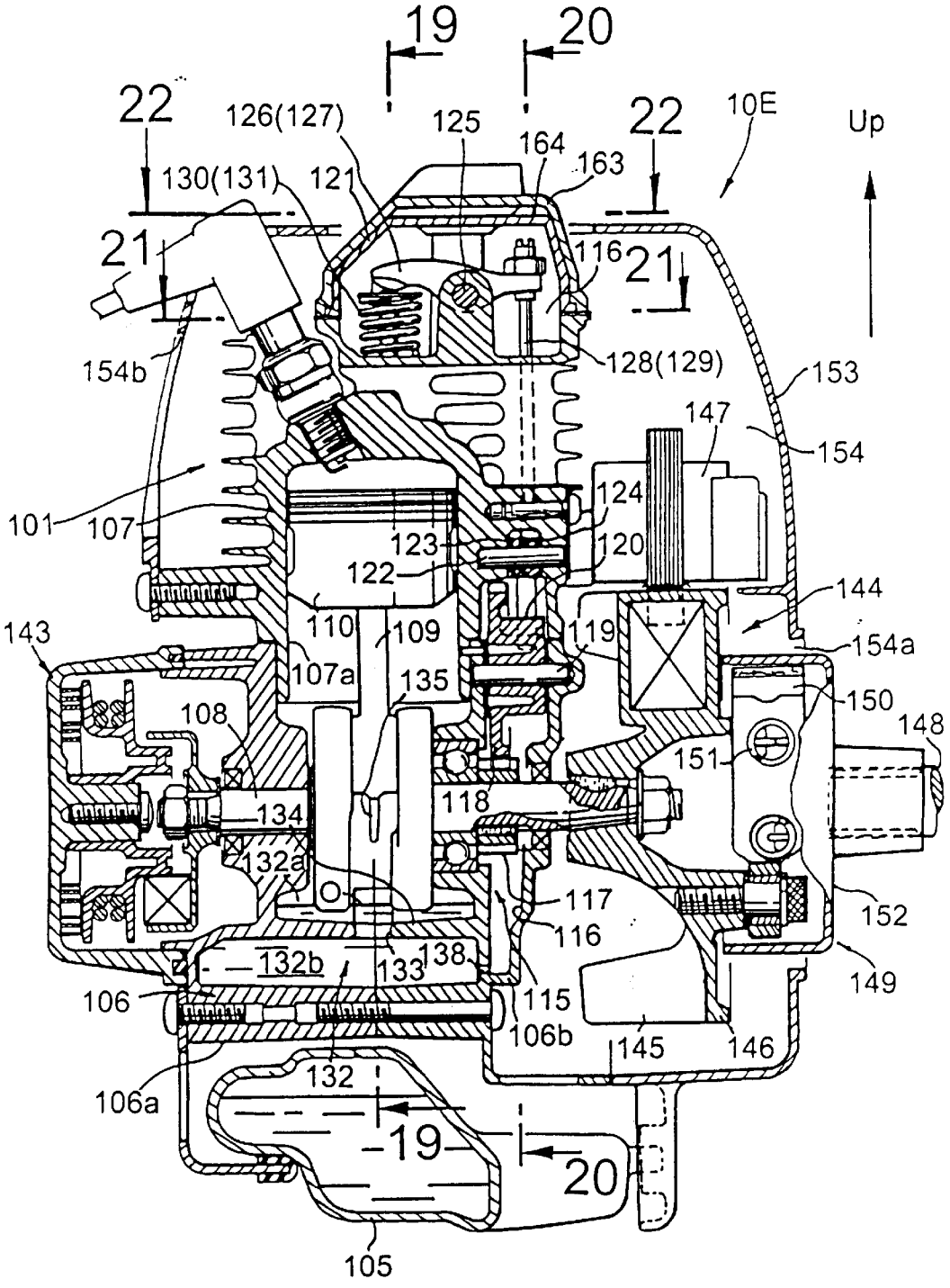
Figure 21:
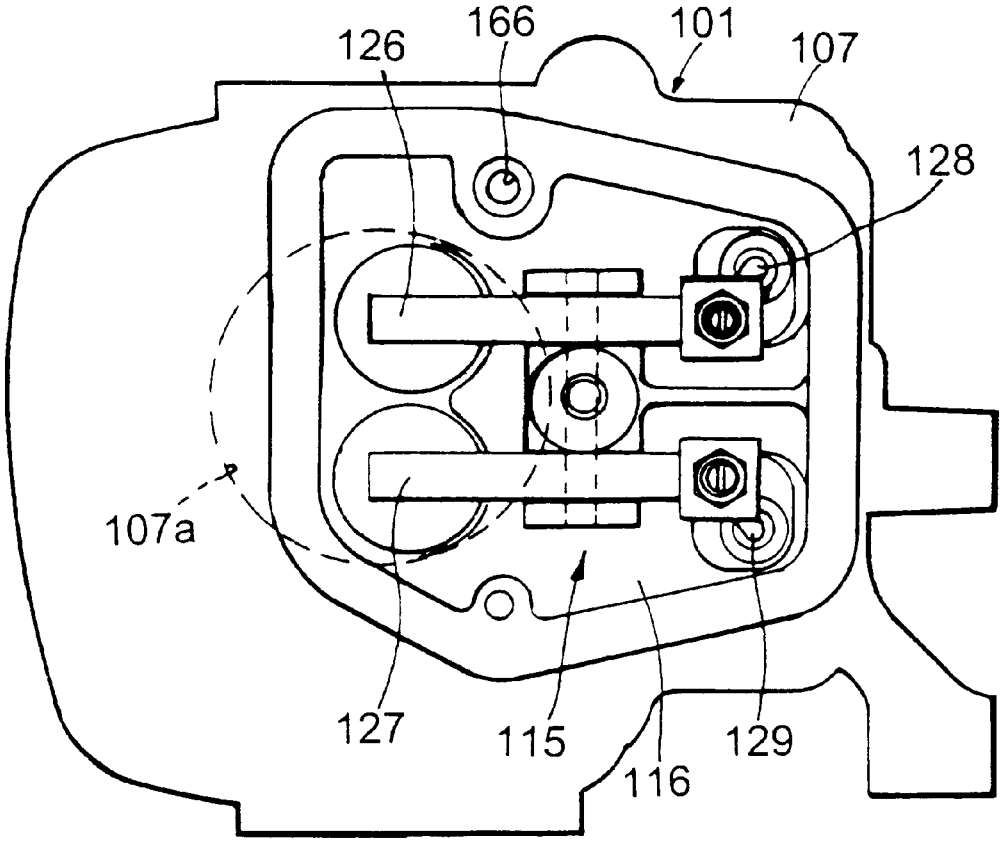
Figure 22:
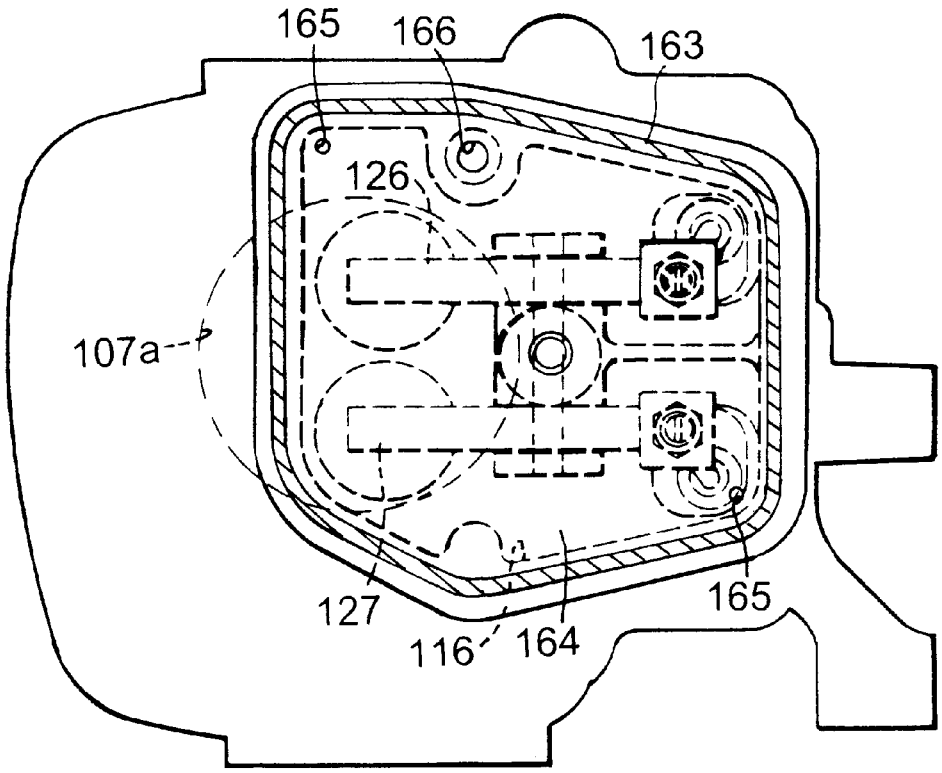

As shown in FIGS. 16, 21 and 22, an outer cover 163 is coupled the head cover 121, so that it is fitted over an outer periphery of the head cover 121. A flat uppermost chamber 164 is defined between ceiling walls of the covers 121 and 163 and communicates with the valve-operating chamber 116 through a pair of orifices 165 provided in the ceiling wall of the head cover 121 at diagonal locations (desirably at four corners). The upper most chamber 164 also communicates with the inner chamber 132*a* of the crank chamber 132 through a series of circulating oil passages 166 provided in the cylinder block 107 and the crankcase 106. The circulating oil passages 166 have a sectional area larger than the total sectional area of the pair of orifices 165.

Thus, by allowing the oil dipper 135 at the enlarged end of the connecting rod 109 to be swung while being vertically moved through the opening 133 between the inner and outer chambers 132*a* and 132*b* of the crank chamber 132 with the rotation of the crankshaft 108 during operation of the engine 10E the lubricating oil is agitated and scattered to produce an oil mist in the crank chamber 122. This oil mist first lubricates the peripheral portions of the crank portions 108*a* and the piston 110, and upon opening of the rotary valve 139, is then supplied along with a blow-by gas through the first and second oil supply passages 136 and 137 into the valve-operating chamber 116, where the oil mist, and the blow-by gas are separated from each other. The oil mist lubricates the various portions of the valve operating device 115, and the blow-by gas is discharged through the breather tube 142 into the air cleaner 104.

The pressure in the crank chamber 132 is pulsated between positive and negative pressures alternatively repeated by elevating and lowering movements of the piston 110. When the positive pressure is generated, the rotary valve 139 is opened to permit the positive pressure to be released via the first end second oil supply passages 136 and 137 into the valve-operating chamber 116. When the negative pressure is generated, the rotary valve 139 is closed to inhibit the back-flow of the positive pressure from the valve-operating chamber 116 and hence, the pressure in the crank chamber 23 is kept negative on an average.

On the other hand, the valve-operating chamber 116 communicates with the inside of the air cleaner 104 which is in an atmospheric pressure state, through the breather tube 142 and hence, the pressure in the valve-operating chamber 116 is substantially equal to atmospheric pressure.

The uppermost chamber 164 communicates with the crank chamber 132 through the oil circulating passage 166 and also with the valve-operating chamber 116 through the orifices 165 and hence, the pressure in the uppermost chamber 164 is equal to or slightly higher than the pressure in the crank chamber 132.

The magnitude relationship between the pressures in the chambers can be represented by the following expression:

$$Pc \leq Pt < Pv$$

wherein, Pc represents pressure in the crank chamber 132, Pt represents pressure in the uppermost chamber 164, and Pv pressure in the valve-operating chamber 116.

As a result, during operation of the engine 10E, the pressure flows through a path which ill be shown below:

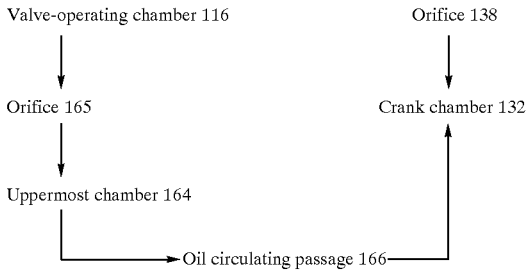

Therefore, the oil mist fed from the crank chamber 132 to the valve-operating chamber 116 is circulated via the path back to the crank chamber 132. The circulation of such oil mist nd the liquefied oil is performed without hindrance even when the engine E is inclined in any attitude.

Figure 24:
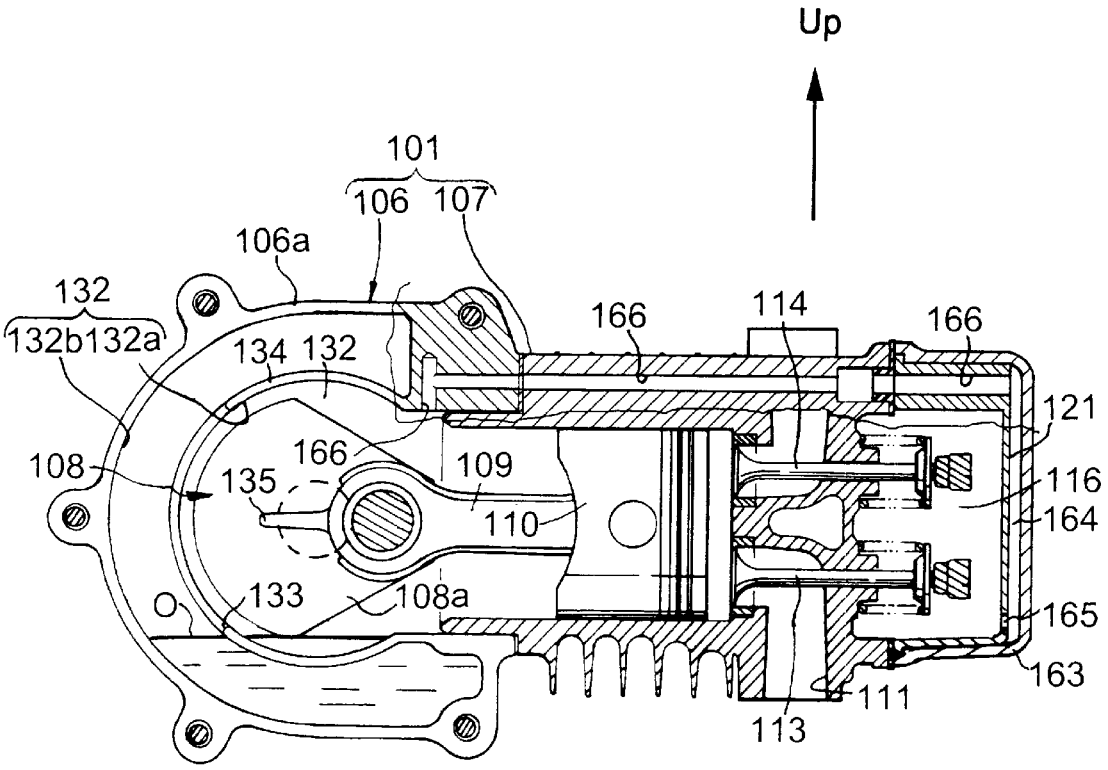
Figure 25:
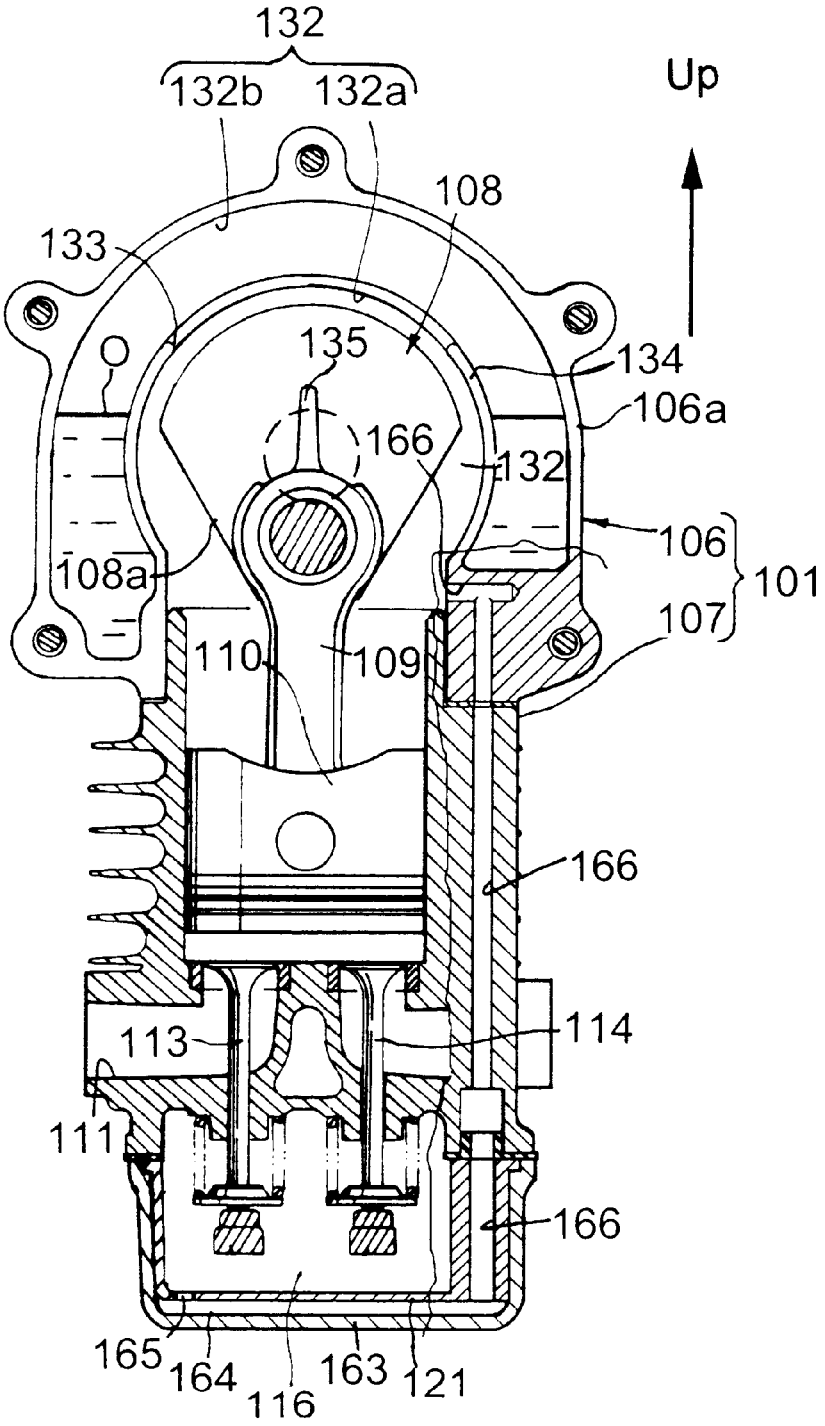

When the engine 10E is fallen sideways or inverted during operation of the engine 10E, as shown in FIGS. 24 and 25, much of the lubricating oil O in the crank chamber 132 flows in a direction to close the outer chamber 132*b*, and the lubricating oil O remains in a smaller amount in the inner chamber 132*a*. Thus, it is possible to prevent the piston 110 from being dipped in the oil end to avoid the entering of the oil into a combustion chamber.

In the operational state of the engine 10E in the sideways-fallen or inverted attitude, the oil liquefied in the valve-operating chamber 116 flows through the orifices 165 into the uppermost chamber 164. However, the pressure relationship between the chambers is maintained and hence, the oil accumulated in the uppermost chamber 164 is drawn through the oil circulating passage 166 into the inner chamber 132*a* in the crank chamber 132.

On the other hand, the oil dipper 135 of the connecting rod 109 is incapable of agitating the lubricating oil in such case, but the oil returned through the oil circulating passage 166 into the inner chamber 132*a* strikes the crank portion 108*a* of the crankshaft 108 and the piston 110 and as a result, such oil is scattered to produce an oil mist again. Therefore, the lubrication of the various portions of the engine 10E cannot be impeded.

Even in any operational attitude such as inclined and inverted attitudes of the engine E, the circulation of the lubricating oil can be conducted without interruption to insure a good lubricating state at all times.

Referring again to FIG. 16, a recoil type starter 143 capable of cranking the crankshaft, 108 is mounted to an outer surface of the crankcase 106 on the opposite side from the valve-operating chamber 116. A rotor 146 of a flywheel magneto 144 with a cooling blade 145 is secured to an outer end of the crankshaft 108 adjacent the valve-operating chamber 116, and an ignition coil 147 cooperating with the rotor 146 is secured to the cylinder block 107. A centrifugal clutch 149 is interposed between the rotor 146 and a working machine driving shaft 148. The centrifugal clutch 149 includes a plurality of clutch shoes 150 expandably carried on the rotor 146, a clutch spring 151 for biasing the clutch shoes 150 in a contracting direction, and a clutch drum 152 secured to the driving shaft 148 to surround the clutch shoes 150. When the rotor 146 is rotated in a predetermined number of rotations or more, the clutch shoes 150 are expanded to come into pressure contact with an inner peripheral surface of the crutch drum 152, hereby transmitting an output torque from the crankshaft 108 to the driving shaft 148.

A shroud 153 is mounted to the engine body 101 to cover the head portion of the engine body 101 and the flywheel magneto 144 and to define a cooling air passage 154 between the shroud and the head portion of the engine body 1 and the flywheel magneto 59. An inlet 154*a* into the cooling air passage 154 is mounted in an annular configuration between the centrifugal clutch 149 and the shroud 153, and an outlet 154*b* is mounted in the shroud 153 on the opposite side from the inlet 154*a*.

Thus, during rotation of the rotor 146, wind produced by the cooling blade 145 flows through the cooling air passage 154 to cool the various portions of the engine 10E.

Although the embodiments of the present invention have been described in detail, it will be understood that the present invention is not limited to the above-described embodiments, and various modifications may made without departing from the spirit and scope of the invention as defined in the claims.

What is claimed is:

1. A system for lubricating a 4-cycle engine, comprising: an oil reservoir chamber which stores a lubricating oil therein and has an oil mist producing means contained therein for producing an oil mist from the lubricating oil;

a crank chamber having a crank portion of a crankshaft contained therein; and a valve-operating chamber having a valve-operating device contained therein, said oil reservoir chamber, said crank chamber and said valve-operating chamber being provided in an engine body, said oil reservoir chamber and said crank chamber being in communication with each other through a through-hole above an oil level in said oil reservoir chamber, said crank chamber and said valve-operating chamber being in communication with each other through a control valve which is opened upon rising of the pressure in said crank chamber and closed upon reduction of the pressure in said crank chamber, said valve-operating chamber being substantially in communication at its upper portion with the atmosphere and at its bottom portion with said oil reservoir chamber through an orifice, and the following expression is established during operation of the engine:

$$Pc \leqq Po < Pv$$

wherein Pc is a pressure in the crank chamber; Po is a pressure in the oil reservoir chamber; and Pv is a pressure in the valve operating chamber.

2. A system for lubricating a 4-cycle engine according to claim 1, further including an uppermost chamber which occupies a position above the valve-operating chamber and to communicate with the valve-operating chamber through an orifice and also communicate with said oil reservoir chamber or said crank chamber through an oil passage, and the following expression is established during operation of the engine:

$$Pc \leqq Po \leqq Pt < Pv$$

wherein Pt is a pressure in said uppermost chamber.

3. A system for lubricating a 4-cycle engine according to claim 1 or 2, wherein said oil mist producing means comprises an oil slinger which is rotated by said crankshaft to agitate and scatter the lubricating oil in said oil reservoir chamber at all times, irrespective of the inclined state of the engine.

4. A system for lubricating a 4-cycle engine according to claim 1, wherein said control valve comprises a one-way valve of pressure-responsive type.

5. A system for lubricating a 4-cycle engine according to claim 1, wherein said control valve comprises a rotary valve which is opened upon the lowering movement of a piston operatively associated with the rotation of the crankshaft and closed upon the elevating movement of the piston.

6. A system for lubricating a 4-cycle engine according to claim 5, wherein the opening duration of said rotary valve is approximately 180° in terms of a crank angle, and the start point of opening of said rotary valve is set in a range of from a middle point between top and bottom dead centers of the piston to a lowering-piston position of 45° of said piston in terms of the crank angle.

7. A system for lubricating an air-cooled 4-cycle engine comprising: a shroud covering an outer periphery of a cylinder block and defining a cooling-air passage between the shroud and the outer periphery of the cylinder block; a cooling blade mounted at one end of a crankshaft supported in a crankcase for feeding cooling air into the cooling-air passage; and a recoil type starter which is mounted to the crankcase to protrude to the outside of the shroud and which is capable of cranking the other end of the crankshaft, wherein said lubricating system further includes an oil reservoir chamber formed in the crankcase and disposed between the recoil type starter and a crank chamber in said crankcase having a crank portion of the crankshaft contained therein for storing a lubricating oil, an oil mist producing means contained in said oil reservoir chamber for agitating the lubricating oil to produce an oil mist, and the oil mist produced in the oil reservoir chamber is supplied to the crank chamber and a valve operating chamber.

* * * * *